US005842266A

United States Patent [19]

Ishiwata

[11] Patent Number: 5,842,266

[45] Date of Patent: Dec. 1, 1998

[54] APPARATUS FOR PRODUCING WIRE HARNESSES

[75] Inventor: Yoshio Ishiwata, Isehara, Japan

[73] Assignee: Molex Incorporated, Lisle, Ill.

[21] Appl. No.: 793,476

[22] PCT Filed: Aug. 29, 1995

[86] PCT No.: PCT/US95/11048

§ 371 Date: May 30, 1997

§ 102(e) Date: May 30, 1997

[87] PCT Pub. No.: WO96/07222

PCT Pub. Date: Mar. 7, 1996

[30] Foreign Application Priority Data

Sep. 1, 1994 [JP] Japan ..... 6-232101

[51] Int. Cl.[6] ..... H01R 43/05

[52] U.S. Cl. ..... 29/564.4; 29/33 M; 29/564.4; 29/753

[58] Field of Search ..... 29/33 M, 564.4, 29/564.6, 749, 753, 755, 566.1, 566.3, 56.6; 140/102

[56] References Cited

U.S. PATENT DOCUMENTS

| | | | |
|---|---|---|---|
| 3,791,008 | 2/1974 | Dyksterhouse | 29/564.6 X |
| 4,375,229 | 3/1983 | Mikami et al. | 29/753 X |
| 4,404,743 | 9/1983 | Brandewie et al. | 29/755 X |
| 4,616,396 | 10/1986 | Matsui | 29/566.1 |
| 4,638,549 | 1/1987 | Okazaki et al. | 29/564.4 |
| 4,646,404 | 3/1987 | Matsui | 29/33 M |

*Primary Examiner*—William R. Briggs

*Attorney, Agent, or Firm*—Charles S. Cohen; Thomas D. Paulius

[57] ABSTRACT

A wire harness producing apparatus has a wire reel supply section (1), a wire inlet section, primary and secondary sections (3, 4), a wire measuring section (5), a wire-cutting section (6), upstream and downstream connector attachment sections (7,8), a wire harness discharge section (9), and cam drives for propelling the primary and secondary chuck sections subsequent to the cutting of electric wires thereby separating cut wires from the remaining wires extending out from the supply reel. The cam drives are also used to operate the wire-cutting section and the upstream and downstream pressing sections in their crimping of connectors onto the cut wires and the remaining wire extensions and also operating the wire harness discharge section to discharge assembled harnesses to a subsequent staging area. The use of these cam drives permits a substantial reduction of the time involved for making the wire harnesses.

18 Claims, 25 Drawing Sheets

APPARATUS FOR PRODUCING WIRE HARNESSES

BACKGROUND OF THE INVENTION

The present invention relates to an electrical wire harness producing apparatus, and more particularly to an improved wire harness producing apparatus using cam drives to control its principal components in measuring and cutting predetermined lengths of wires and in crimping connectors to the opposing ends of the measured and cut wires arranged laterally in parallel.

DESCRIPTION OF THE PRIOR ART

Electrical wire harnesses are well known in the art and a number of proposals have been made for improvements in the harnesses and apparatus have been made. The principal components of such wire harness producing apparatus carry out the steps of: (1) drawing and measuring wires from wire supply reels; (2) stretching and cutting the drawn and measured wires; (3) terminating the wires to one or opposite ends of the cut wires arranged laterally in parallel; and, (4) discharging the terminated harnesses to a subsequent stage wherein they are tested for electrical characteristics. These principal components of such known wire harness producing apparatus are driven by associated pneumatic cylinders which operate wire chuck means, cutting-and-stripping blades, pressing dies, and operating discharging rod means, although some drive means other than pneumatic drives are used as auxiliary.

Primary and secondary wire chucks are used to stretch electric wires therebetween while cutting the wires from the supply reel and to separate cut lengths of wires from the remaining wires extending from the supply reel. The primary and secondary wire chucks are placed at stationary positions and operate by opening and closing jaws to hold and release the electric wires.

In instances where connectors are crimped on one set of ends of the parallel wires the wire insulation is removed from the opposing ends of the wires, a composite blade assembly having a wire-cutting blade and an insulation-stripping stripping blade is used which permits the insulation-stripping blade to cut a line in the wire insulation at the time of cutting each wire spaced apart from the line, and then strips the wires by displacing them toward the insulation-stripping blade.

As described earlier, all principal components for displacing the primary and secondary wire chucks, cutting electric wires, terminating electric connectors and discharging electric harnesses are known to be driven by associated pneumatic cylinders. One disadvantage to this arrangement is that subsequent pneumatic operations cannot be started before confirming that the preceding pneumatic operations have been completed. A delay is involved for the receipt of a signal indicating the completion of the preceding pneumatic operation. This delay time is cumulative for each principal operation, and its accumulation prevents the reducing the time required for producing wire harnesses below a certain limit.

In the case of relatively long wires (about 1500 mm long) stretched between the primary and secondary wire chucks, the wires tend to droop or tangle thereby causing the wires to be arranged at irregular intervals at their ends which are to be gripped by the secondary chuck. There is then a concern that the secondary chuck will improperly engage selected wires by their insulations which will provide defective wire harnesses.

Also, when the discharge rods are pneumatically driven to discharge the wire harnesses, one discharge rod may lead the other discharge rod, resulting in the wire harnesses being obliquely driven to a subsequent testing stage, in which they may take a wrong posture for testing which will prevent them from being properly tested.

The use of the dual blade structure in stripping electric wires also limits the shortest stripping length to the total thickness of the insulation-stripping blade and the wire-cutting blade, thus preventing selection of the stripping length below the wire-cutting blade, which is thick relative to the insulation-stripping blade.

SUMMARY OF THE INVENTION

The present invention is directed to a wire harness producing apparatus which overcomes the aforementioned disadvantages. Accordingly, it is an object of the present invention to provide a wire harness producing apparatus which substantially shortens the time involved for producing wire harnesses no matter whether the harnesses have connectors terminated to one or opposite ends of the harness wires.

Another object of the present invention is to provide a wire harness producing apparatus capable of displacing its primary chuck to the vicinity of the secondary chuck beyond the wire cutting position, thereby permitting a plurality of wires to be held at regular intervals, and permitting the termination of connectors to the wires laterally arranged at regular intervals without a fear of pressing into the insulation of selected wires, thereby providing defective products.

Still another object of the present invention is to provide a wire harness producing apparatus whose discharge rods are cam-driven to assure the perfect synchronization of the discharge rods as well as the transport of wire harnesses in the condition in which they are laid transversely relative to the travelling direction. Consequently, all of the wire harnesses can be tested smoothly at the subsequent testing stage.

Still another object of the present invention is to provide a wire harness producing apparatus using an insulation-stripping blade spaced apart from a wire-cutting blade, thereby permitting reduction of the insulation-stripping length compared with the conventional wire harness producing apparatus using a composite, wire-cutting and insulation-stripping blade.

In order to attain these objects and advantages, apparatus for producing wire harnesses according to the present invention comprises: (1) a wire supply reel section for unwinding a plurality of wires; (2) a wire inlet section for arranging and guiding the electric wires laterally in parallel from their supply reels; (3) primary and secondary chuck sections for holding wires arranged laterally in parallel, the secondary chuck section being placed downstream of the primary chuck section in the direction in which the wires travel; (4) a wire measuring section for drawing a predetermined length of the wires from their supply reels and arranged laterally in parallel; (5) a wire-cutting section for cutting the wires between said primary and secondary chuck sections while the wires are stretched by said primary and secondary chuck sections; (6) upstream and downstream pressing or die sections for respectively terminating electric connectors on one end of the cut wires separate from the remaining wires extending from the wire supply reels, and for crimping connectors on the end each of the remaining wire extensions of the wire supply reels; (7) a wire harness discharging section for directing to a subsequent working stage, wire harnesses composed of predetermined lengths of parallel wires having connectors terminated to their opposite ends; and (8) cam drive means for moving the primary and secondary chuck sections subsequent to cutting of the wires, thereby pulling the cut wires out from the remaining wire extensions from the wire-unwinding reel, for enabling cutting of the wires by the wire-cutting section, for activating the upstream and downstream pressing sections to terminate electric connectors to the cut wires and the free ends of the wires extending from the supply reel, and for discharging the wire harnesses.

In this regard, the primary chuck section may include self-moving means for travelling along the wires to the vicinity of said secondary chuck section beyond said wire-cutting section after measuring the wires, but before permitting the secondary chuck section to grasp the wires, thereby permitting the primary chuck section to hold the wires laterally at their regular intervals.

The wire harness discharging section may include longitudinal discharge rods for discharging wire harnesses by pushing the connectors terminated to their opposing ends, the discharge rods being adapted to be driven in synchronization with the cam drive means.

An apparatus for producing wire harnesses according to the present invention is seen to comprises: a supply section having a plurality of wire supply reels for feeding a like plurality of wires; a wire inlet section for arranging and guiding the wires into the harness apparatus and holding them in a parallel relationship; primary and secondary chuck sections for holding the wires in their parallel order, the secondary chuck section being disposed downstream of the primary chuck section in the direction in which the wires are fed; a wire measuring section for drawing a predetermined length of the plurality of wires from their respective supply reels; a wire-cutting section for cutting the wires between the primary and secondary chuck sections while the wires are stretched by the primary and secondary chuck sections; a downstream pressing, or die, section for terminating one or more connectors to one set of free ends of the cut wires, separate from the remaining wires extending from the wire supply reels; a wire-stripping blade for stripping the insulation from the exposed ends of the wires extending from the supply reels to expose portions of their internal conductors; a wire harness discharging section for directing to a subsequent working stage assembled harnesses composed of predetermined length of wires with connectors terminated to one set of free ends thereof; and cam drive means for moving the primary and secondary chuck sections subsequent to cutting of the wires, thereby moving the cut set of wires apart from the remaining wires extending from the wire supply reels, enabling the wire-cutting section to cut the wires, enabling the downstream pressing section to terminate connectors to one set of free ends of the cut wires, and enabling the wire harness discharging section to discharge completed wire harnesses.

The primary chuck section may have self-moving means for travelling along the wires to the vicinity of the secondary chuck section beyond the wire-cutting section after measuring the wires, but before permitting said secondary check section to hold the wires, thereby permitting the primary chuck section to hold the wires laterally at regular intervals.

The insulation-stripping blade may be positioned apart from the wire cutting section and may be equipped with means for withdrawing the primary check section while gripping the remaining wire extensions subsequent to the cutting of the insulations of the wire extensions by the insulation-stripping blade, thereby exposing the conductors at the ends of the remaining wire.

These and other objects, features and advantages of the present invention will be clearly understood through a consideration of the following detailed description.

BRIEF DESCRIPTION OF THE DRAWINGS

In the course of this description, reference will be frequently made to the attached drawings in which.

DESCRIPTION OF THE PREFERRED EMBODIMENTS

Figure 1:
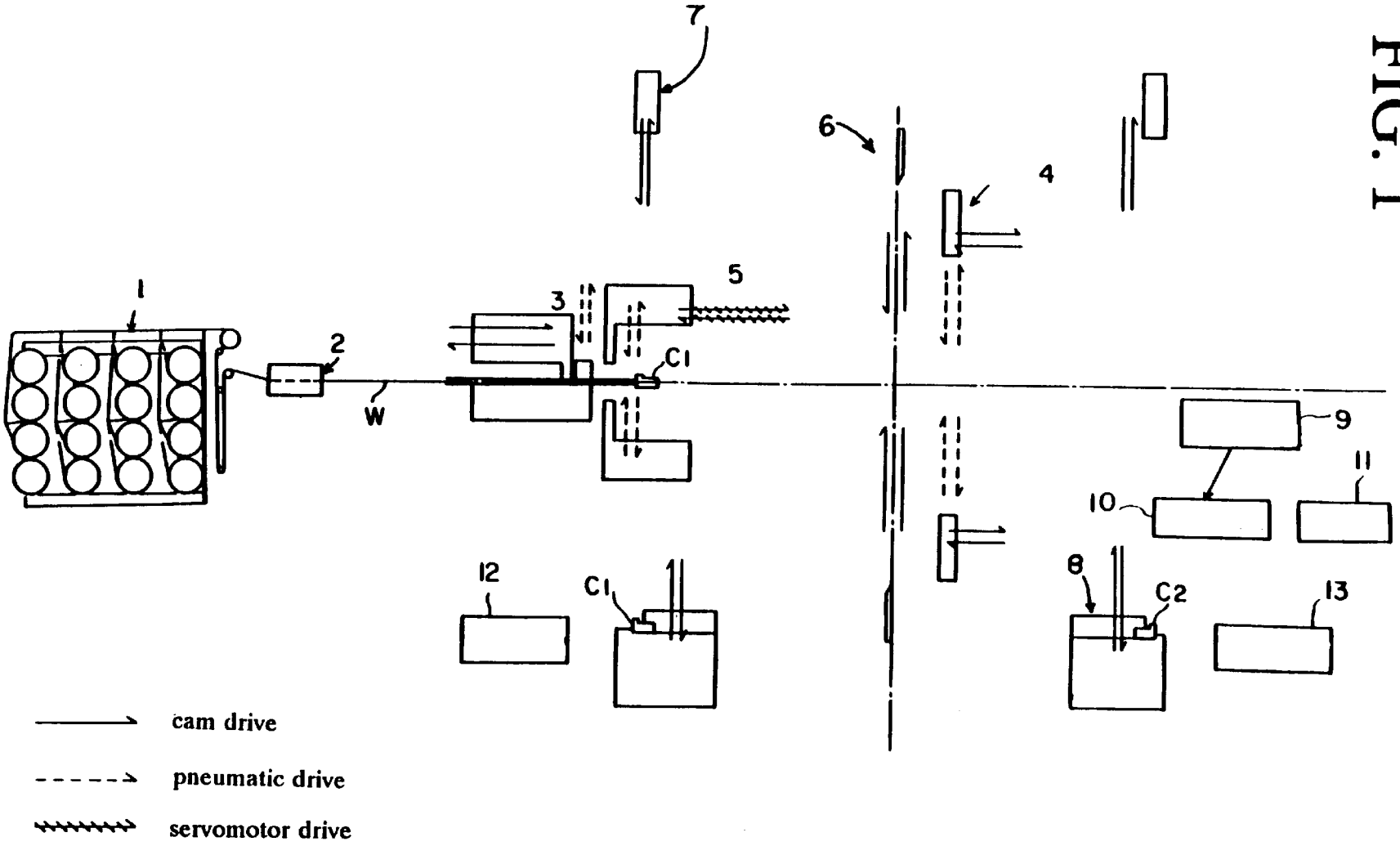
FIG. 1 is an operational schematic diagram illustrating the principal components of a first embodiment of a wire harness producing assembly constructed in accordance with the principles of the present invention and identifying their respective driving means used in their modes of operation.

Referring to FIGS. 1 to 11, a first embodiment of a wire harness producing apparatus constructed in accordance with the principles of the present invention is diagrammatically depicted. The apparatus is designed to permit the measuring and cutting of electric wires W of any desired length in parallel order as well as terminating of electric connectors C1 and C2 to opposite ends of the measured and cut wires, while so arranged in parallel. FIG. 1 is a diagrammatic block diagram of the wire harness apparatus, and FIGS. 2 to 10 show the operational steps of the apparatus, namely: a plurality of electric wires W being measured and cut; connectors C1 and C2 being terminated to opposite ends of the measured and cut wires; and the completed wire harnesses A being discharged to a subsequent working stage.

Referring to FIG. 1, the wire harness producing apparatus comprises: a wire supply section 1 composed of a group of wire supply reels for unwinding a plurality of wires W therefrom; a wire inlet section 2 for arranging and guiding the wires W from their supply reels laterally in parallel; and, a pair of wire chucks having primary and secondary chuck sections 3 and 4 for holding the wires in their parallel arrangement. The secondary chuck section 4 is located downstream of the primary chuck section 3, namely, in the direction in which the electric wires W travels during processing. The wire harness apparatus further comprises: a wire measuring section 5 for drawing a predetermined length each of the wires W; a wire-cutting section 6 for cutting the wires W between the primary and secondary chuck sections 3 and 4 while the wires W are stretched by the primary and secondary chuck sections 3 & 4; upstream and downstream pressing, or die, sections 7 & 8 for terminating electric connectors C2 onto one set of free ends of the cut wires (which are separate from the remaining wires extending out from the wire supply reel section 1) and for terminating electric connectors C1 onto the free ends of the remaining wire extensions; and a wire harness discharging section 9 for directing to a subsequent working stage, assembled wire harnesses A each composed of wires of predetermined length with connectors terminated to their opposing ends. A wire harness transfer section 10 and a checking section 11 are placed close to the electric harness discharging section 9. The pressing die of each of the upstream and downstream pressing sections 7 & 8 is associated with a connector feeding section 12 & 13.

Figure 12:
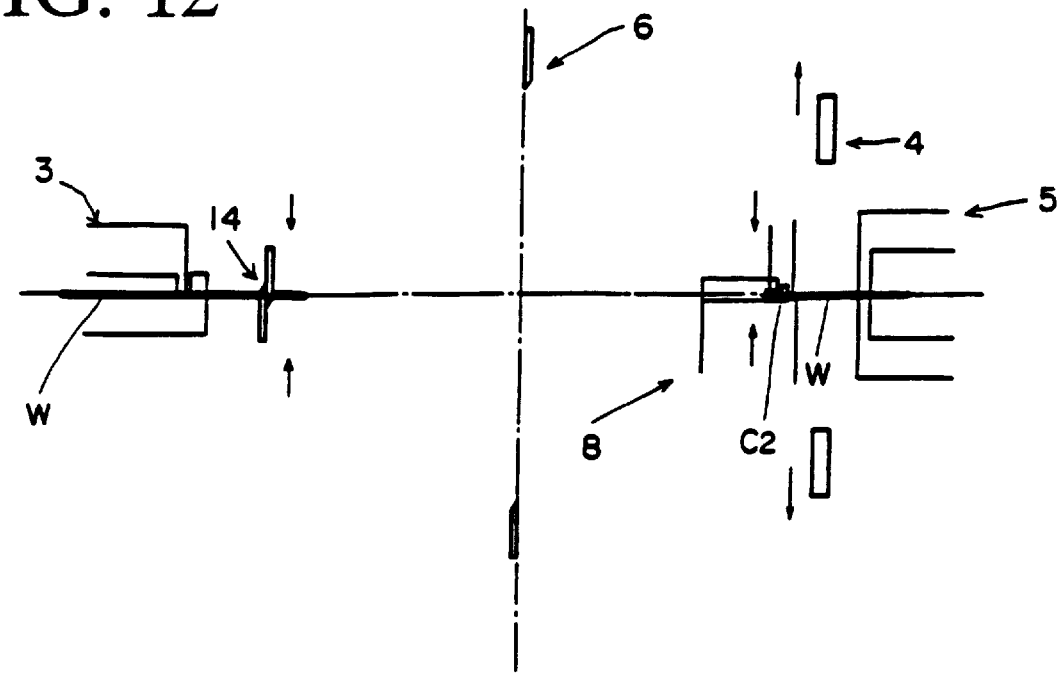
FIG. 12 is an operational schematic diagram illustrating a second embodiment of a wire harness producing apparatus constructed in accordance with the principles of the present invention and further illustrating the application of an insulation stripping blade to a set of wires drawn from their supply reels.
Figure 13:
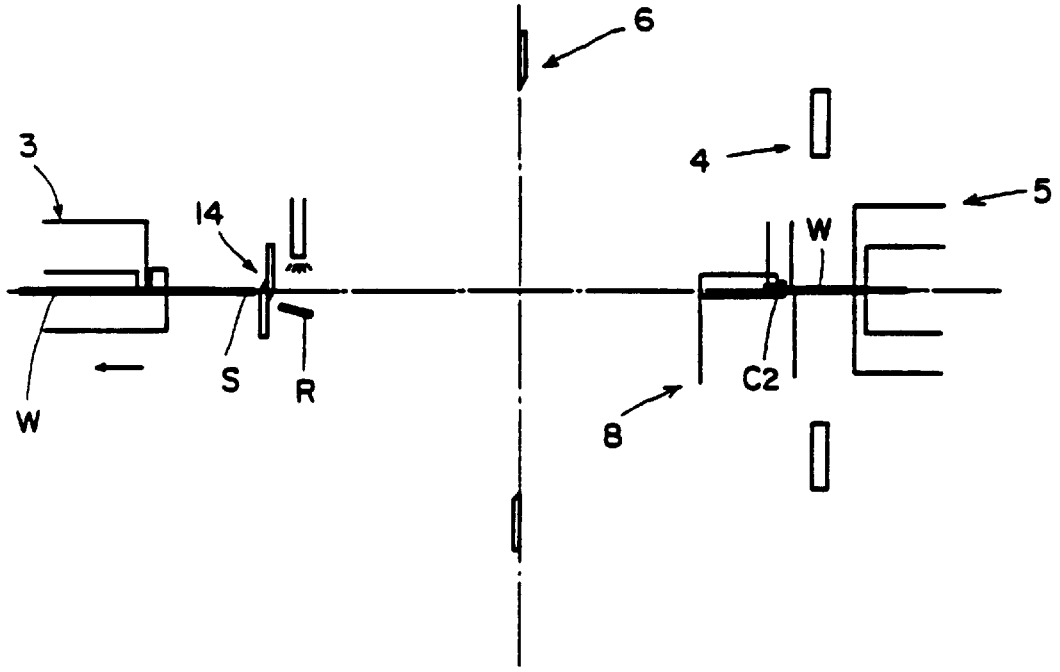
FIG. 13 is an operational schematic diagram of the wire harness apparatus of FIG. 12 illustrating the stripping of insulation from the ends of the first set of wires.
Figure 14:
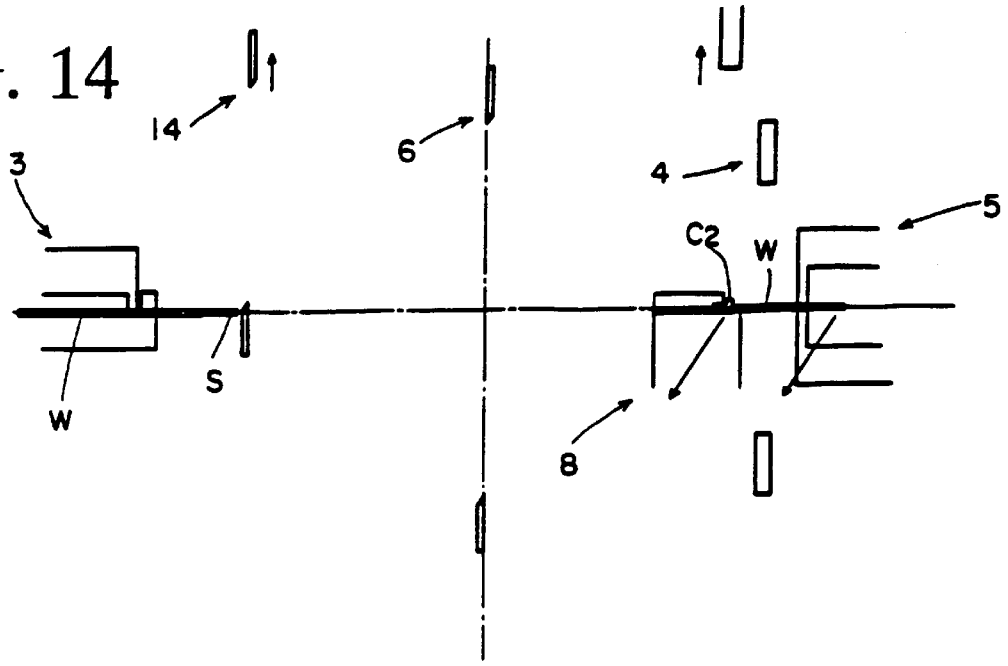
FIG. 14 is an operational schematic diagram of the wire harness apparatus of FIG. 12 illustrating the upper insulation-stripping blade in a raised, or withdrawn, position.
Figure 15:
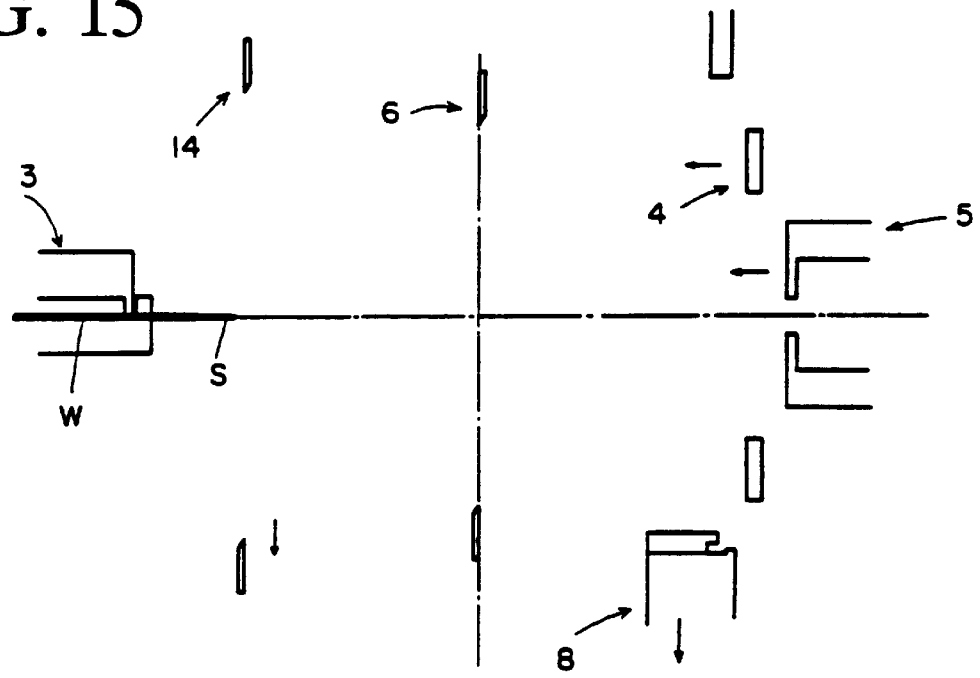
FIG. 15 is an operational schematic diagram of the wire harness apparatus of FIG. 12 illustrating the lower insulation-stripping blade in a lowered, or withdrawn, position.
Figure 16:
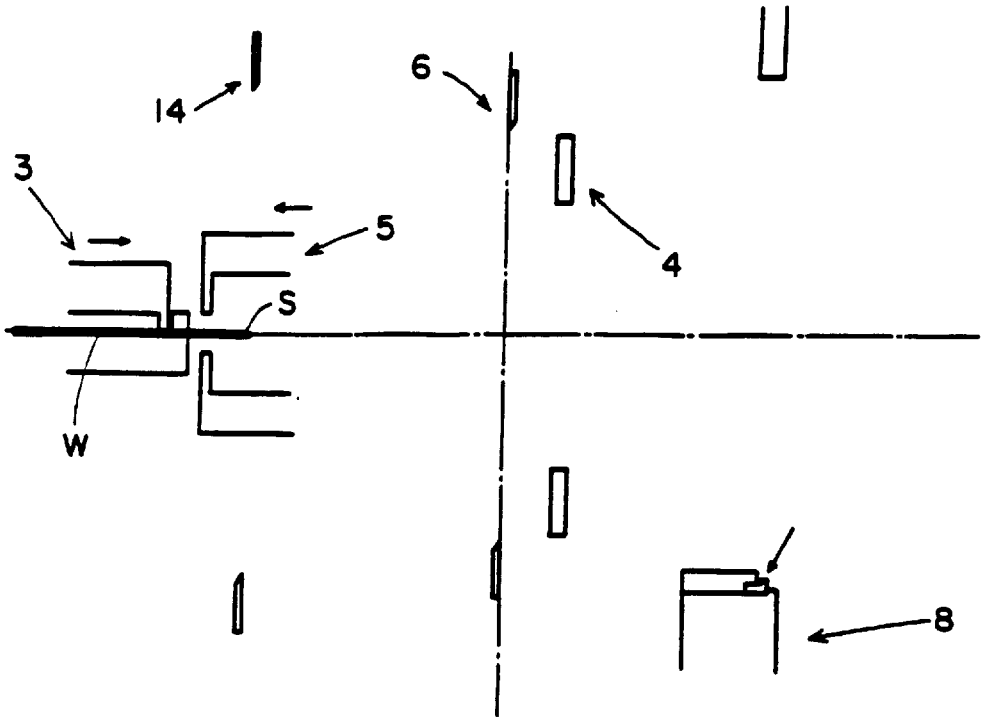
FIG. 16 is an operational schematic diagram of the wire harness apparatus of FIG. 12 illustrating the measuring chuck returning to an initial position after stripping of the wires.
Figure 32:
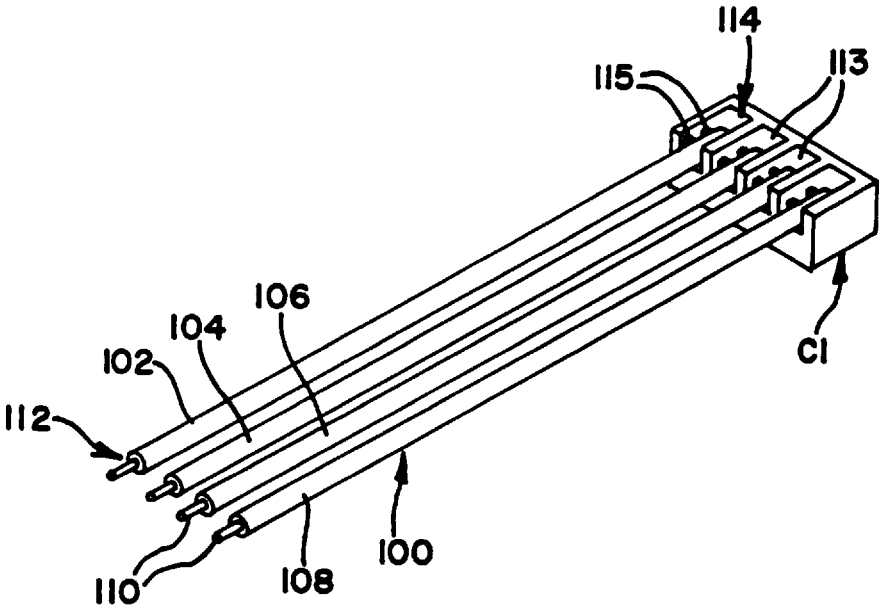

FIG. 32 illustrates a partially completed wire harness 100 of the type typically produced by the apparatus of FIGS. 1 & 12. It can be seen that the harness 100 includes four conductive wires 102–108 arranged laterally in parallel and having interior conductive portions 110 exposed during an insulation-stripping process. The wires 102–108 include two opposing sets of free ends 112, 114, one of which is illustrated as exposed and the other terminated to an electrical connector element C1 of the type having parallel, wire-receiving cavities 113 with a plurality of insulation displacement terminals 115 arranged therein. These insulations displacement terminals are of the type which include erect prongs or the like having a channel therebetween which receives the wires therein. When the wires are pressed into these insulation displacement terminals, the prongs pinch the wires and cut, or displace into the wire outer insulation to contact the interior conductive portions 110 to effect a reliable electrical connection.

Figure 17:
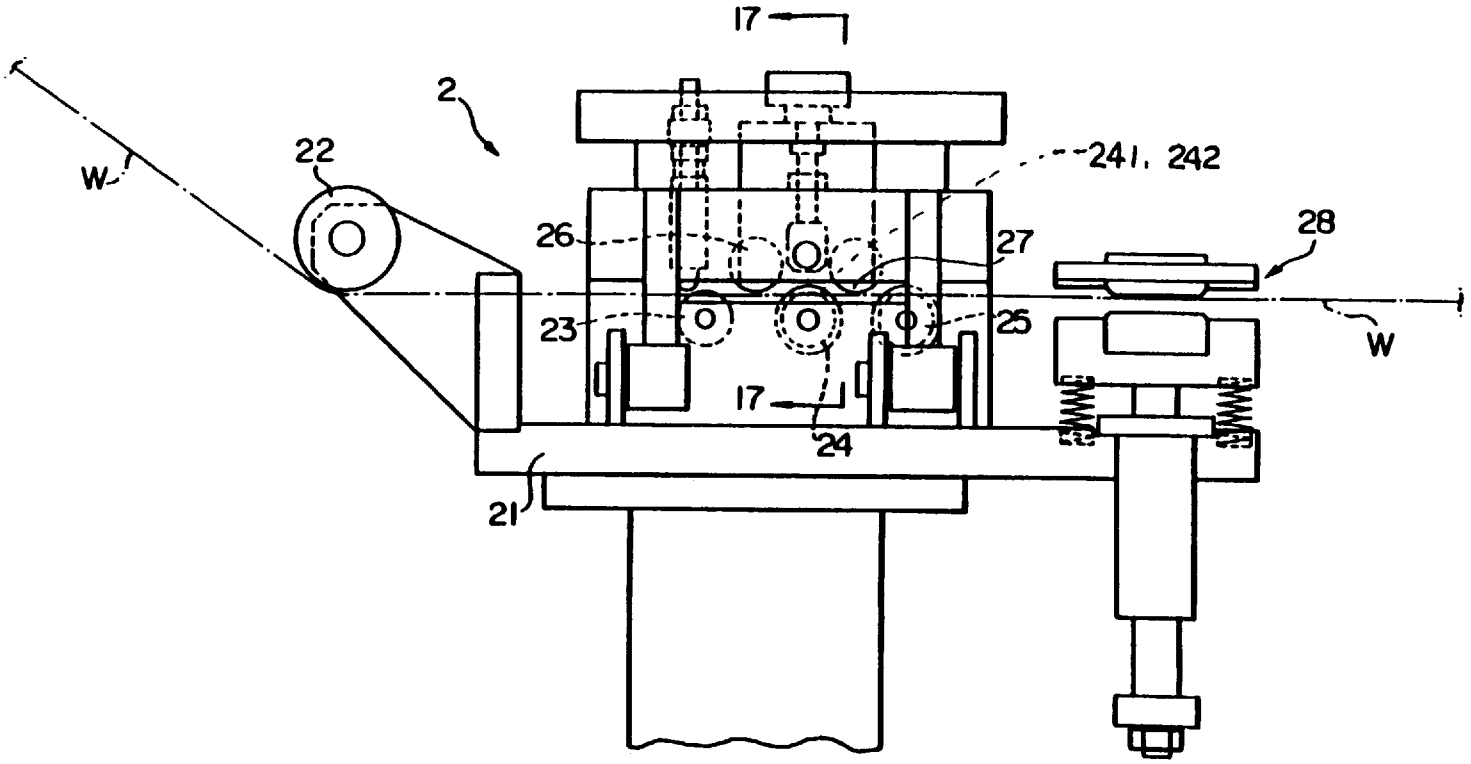
FIG. 17 is an elevational view of the wire harness apparatus of FIGS. 1 and 12 illustrating the wire inlet section thereof.
Figure 18:
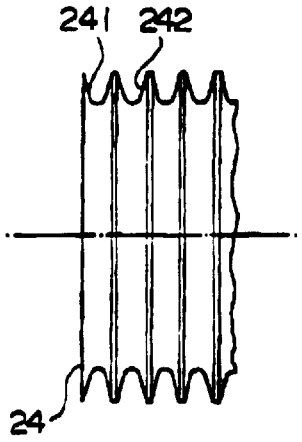
FIG. 18 is view taken along line 17—17 of FIG. 17 illustrating a guide roller used in the wire inlet section of FIG. 17.

Referring now to FIGS. 17 to 31, the principal parts of the wire harness producing apparatus are described to follow. Referring particularly to FIG. 17, a first embodiment of the wire inlet section 2 comprises a base 21 and a wire inlet roller 22 fixed to one end of the base 21. A series of guide rollers 23, 24 & 25 are arranged at regular intervals in the downstream direction and wire tensioning rollers 26 & 27 are located between adjacent guide rollers 23, 24 & 25 as illustrated. A crimper 28 is located downstream of the guide rollers 23, 24 & 25. Each of these rollers 22–27 preferably includes a series of circumferential grooves 241, 242 corresponding in number to the number of wires arranged in parallel for assembly into a harness, as seen from FIG. 18, which shows the roller 24 for example.

Figure 19:
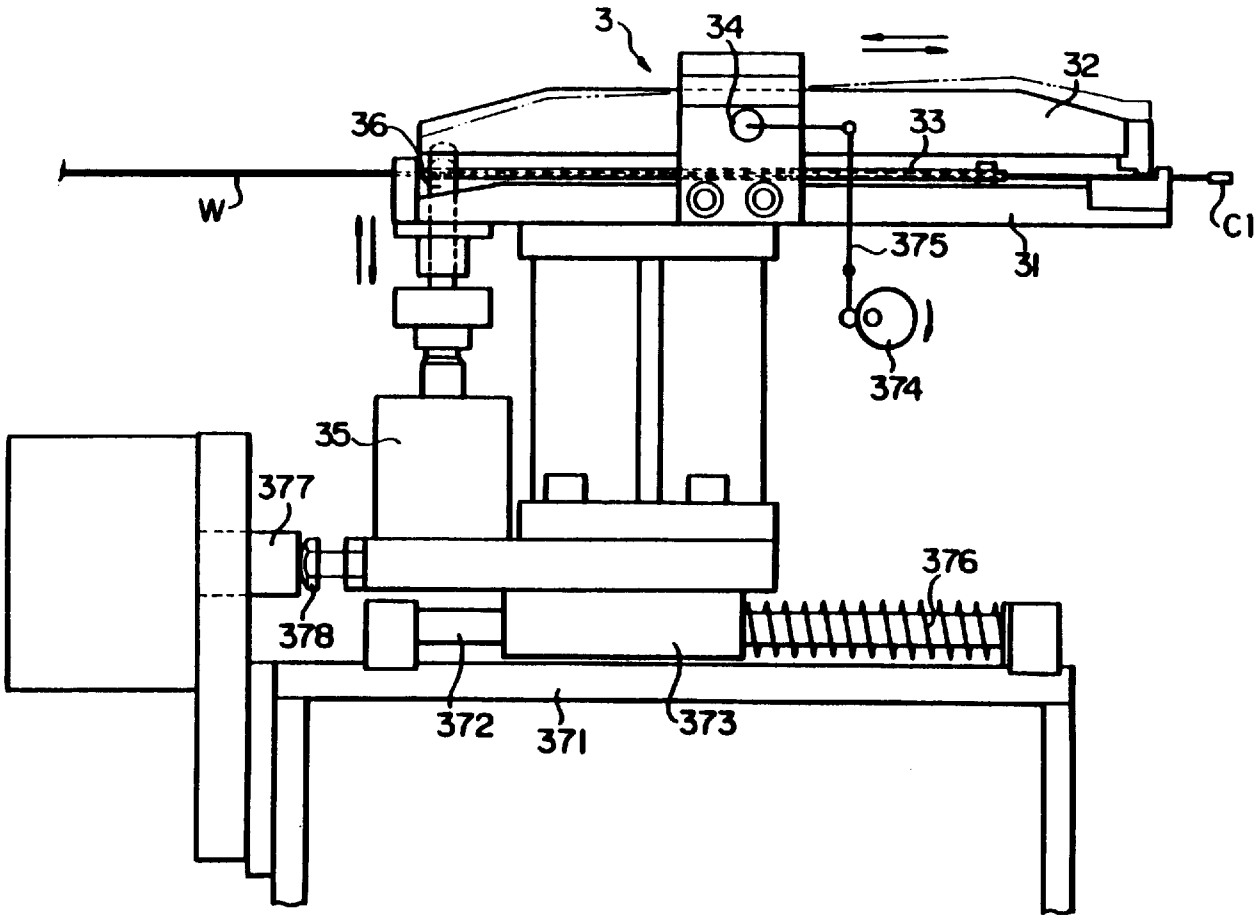
FIG. 19 is an elevational view of the wire harness apparatus of FIGS. 1 and 12 illustrating the primary chuck portion thereof.

Referring specifically to FIG. 19, the primary chuck section 3 includes means for gripping and releasing an arrangement of wires W arranged in parallel with a regular spacing maintained between adjoining wires. The primary chuck section 3 comprises a base 31, a chuck arm 32 and a plurality of wire-threading pipes, or tubes 33, arranged in parallel laterally along the base 31 and disposed on the base 31 underneath the chuck arm 32, which is pivoted to swing about a central pivot point 34. An associated operating means, such as the pneumatic piston and cylinder 35, 36 illustrated is positioned thereon with its piston 36 abutting on one end of the chuck arm 32. When the piston 36 displaces upwardly to raise one end of the chuck arm 32, the chuck arm 32 pivots about 34 and lowers the other end of the chuck arm 32, thus contacting the wires appearing out of the wire-threading pipes 33 by pressing them against the base 31. The withdrawing of the piston 36 causes the chuck arm 32 to release the electric wires W.

The primary chuck section 3 is fixed to a slider 373, which is designed to slide on rails 372 disposed on a support bed 371. A cam 374 is operatively connected to an associated transmission link 375. Rotational movement of the cam 374 transmits movement to the primary chuck section 3 through linkage 375, thereby moving the primary chuck section 3 toward the secondary chuck section 4. The slider 373 is spring-biased toward its initial position, thus permitting the primary chuck section 3 to withdraw until the abutting end 378 of the slider 373 has abutted against a stopper 377.

Figure 20:
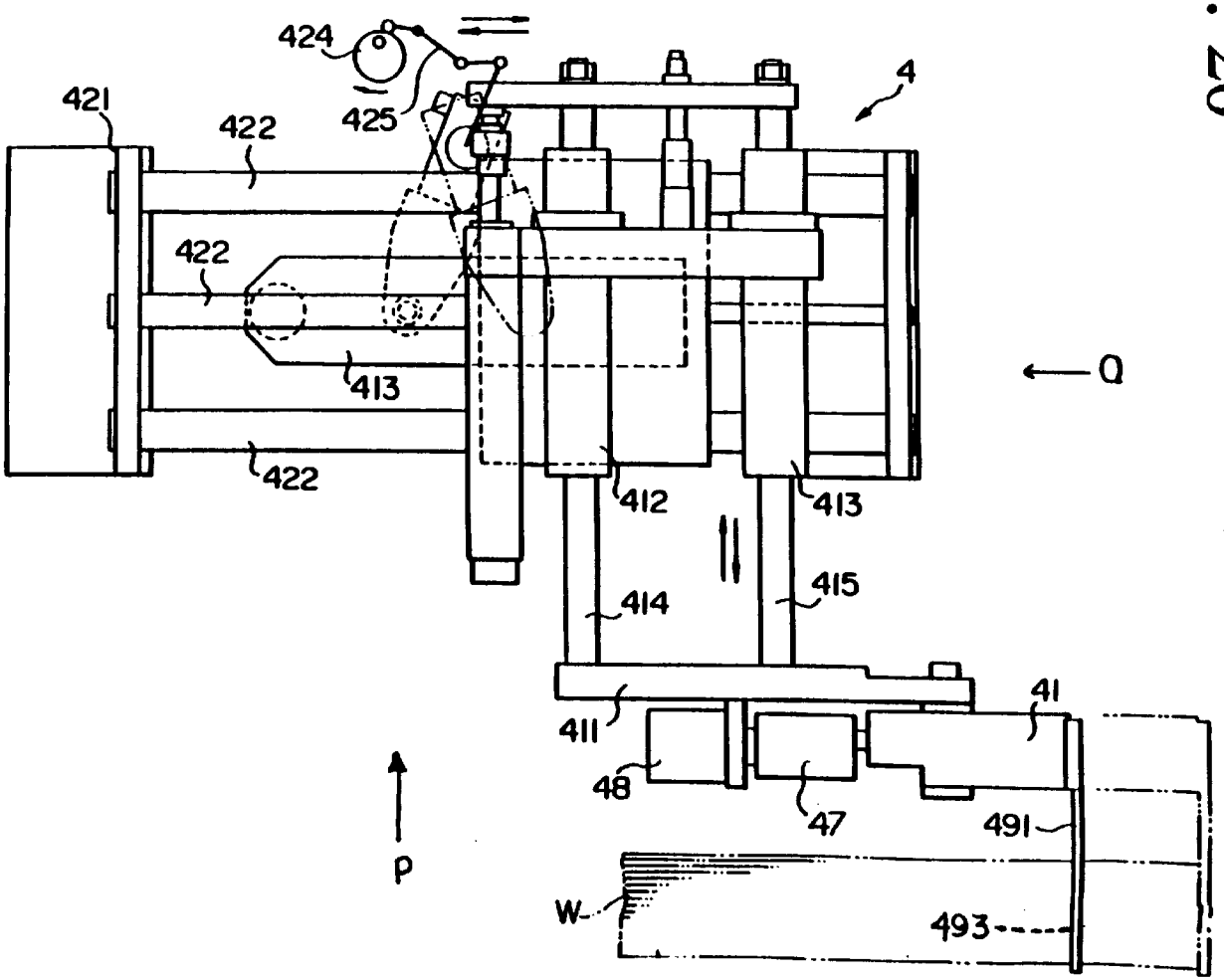
FIG. 20 is a plan view of the secondary chuck suitable for use in the embodiments of FIGS. 1 and 12.
Figure 21:
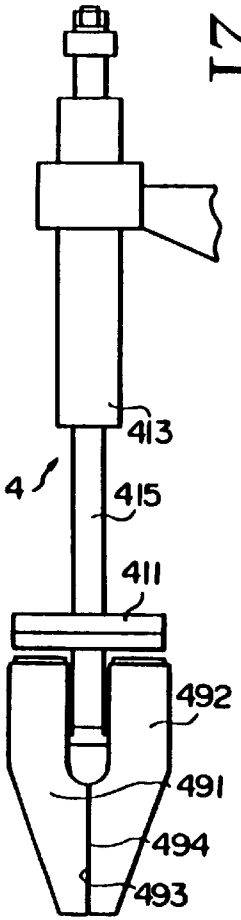
FIG. 21 is an end view of the secondary chuck as indicated along the arrow Q of FIG. 20.
Figure 22:
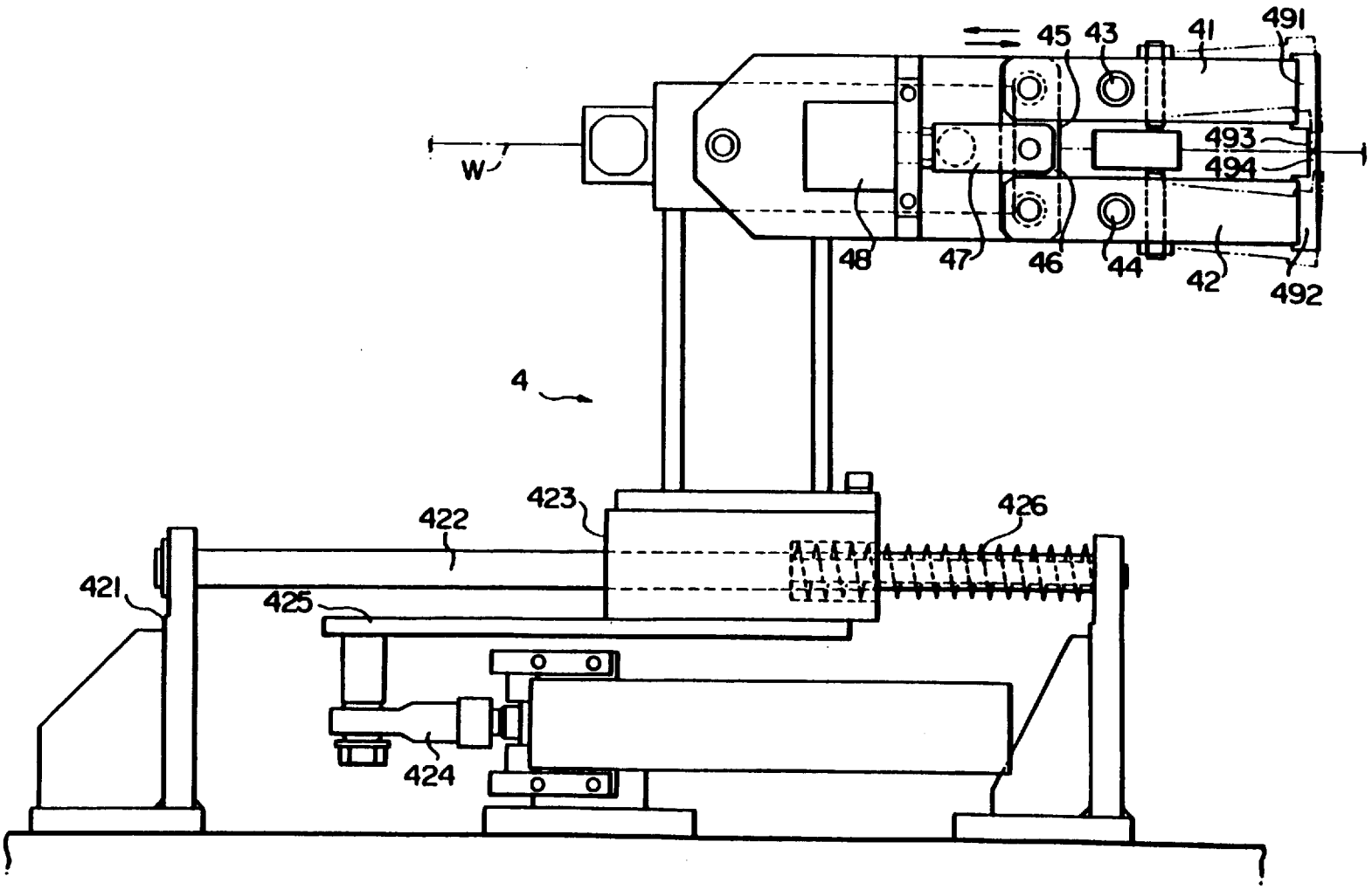
FIG. 22 is a side view of the secondary chuck as viewed along the arrow P of FIG. 20.

Referring to FIGS. 20, 21 and 22, the secondary chuck section 4 comprises means for gripping and releasing plurality of wires W arranged in parallel, means for displacing the wire gripping-and-releasing means to the vicinity of the wires W, and means for moving the entire chuck section back and forth along the wire feed line. First, as best seen in FIG. 22, the wire gripping-and-releasing means comprises a pair of opening-and-closing arms 41 & 42 pivoted at 43 & 44 and a pair of links 45 & 46 operatively connected to the rear ends of the arms 41 and 42. A pneumatic cylinder 48 with a piston 47 is operatively connected to the links 45 & 46. Each arm 41, 42 preferably includes a wire chuck head 491, 492 fixed to its end. These wire chuck heads 491, 492 extend transversely from the ends of the arms 41, 42 to establish the forward edges 493 and 494 of the chuck section 4. Second, as best seen in FIG. 20, the means for displacing the wire gripping-and-releasing means to the vicinity of the electric wires W comprises a pair of pneumatic cylinders 412, 413 whose pistons 414, 415 are connected to a frame 411 to which the wire gripping-and-releasing means is attached.

These pneumatic cylinders 412, 413 are fixed to a slidable base 423, which slides on rails 422, 422 shown extending horizontally between opposite stands 421. Rotation of cam 424 transmits movement to the slidable base 423 via an associated link mechanism 425, thereby moving the slidable base 423 and its associated wire gripping-and-releasing means back and forth.

Referring to FIGS. 23–26, one example of the measuring chuck section 5 suitable for use with the present invention is described. First, referring to FIGS. 25 & 26, a wire gripping-and-releasing means is illustrated therein as having a pair of opening-and-closing arms 51 & 52 pivotally mounted at 55 & 56, a pair of links 57 & 58 operatively connected to the rear ends of the arms 51 & 52, and a pneumatic cylinder 50 having a piston 59 operatively connected to the ends of the links 57 & 58. Advancement of the piston 59 causes the tip ends 53, 54 of the arms 51 & 52 to open, while withdrawal of the piston 59 causes the tip ends 53, 54 of the arms 51 & 52 to close. The wire gripping-and-releasing means is fixed to a movable base 514, (best illustrated in FIG. 23) which is driven back and forth on a stationary base 511 by a servomotor 512 which, as illustrated, may be operatively connected to a threaded shaft 513.

Figure 27:
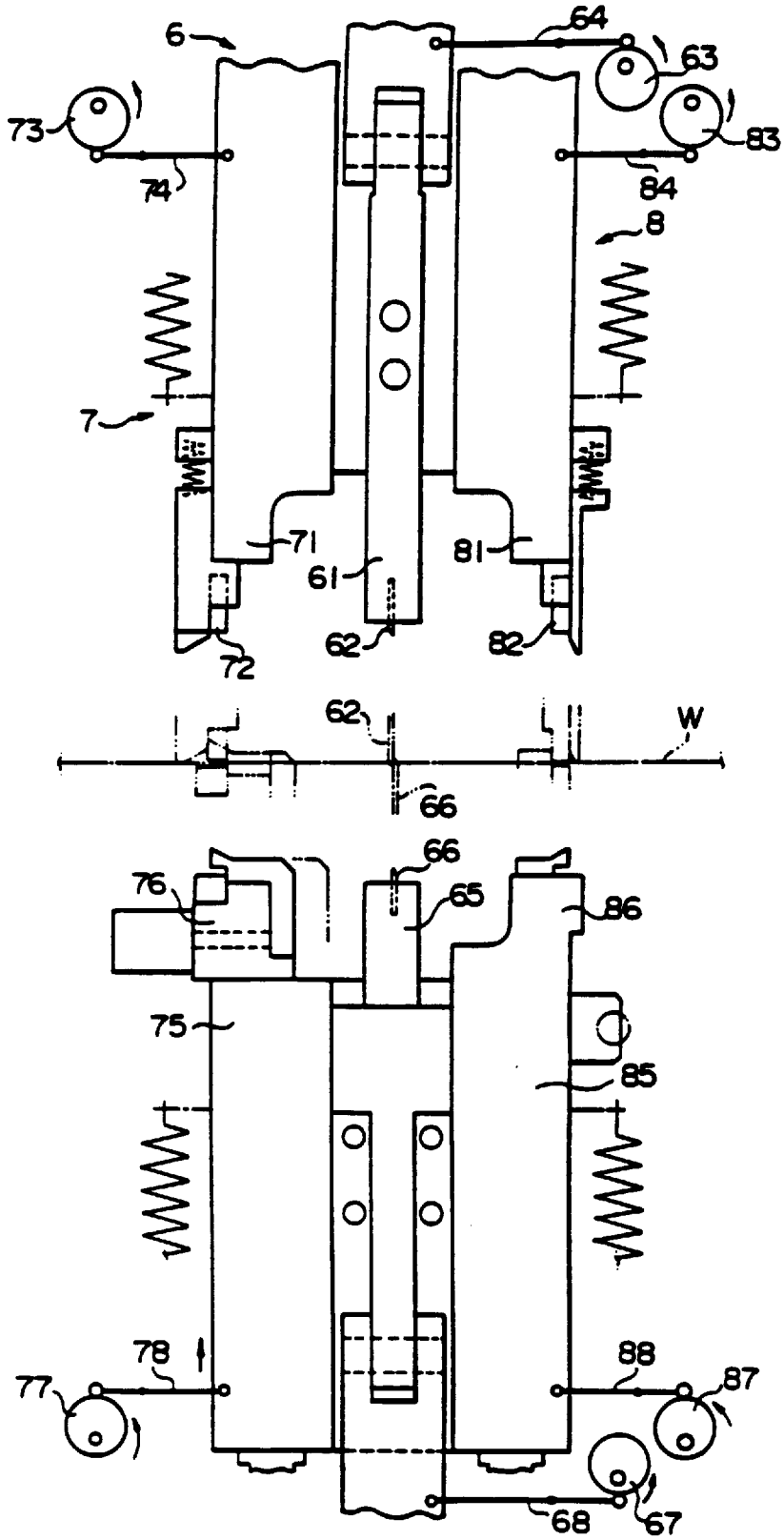
FIG. 27 is an elevational view of the wire-cutting components and the upstream and downstream connector termination components for the embodiment of the wire harness apparatus illustrated in FIGS. 1–11.

Referring now to FIG. 27, one example of a wire cutting section 6 suitable for use with the present invention is illustrated. The section 6 has upper and lower cutting blades 62 & 66 fixed to respective opposing blade holders, or knife assembly arms, 61 & 65. Rotational movements of two driving cams 63 and 67 is transmitted to these blade holders 61 & 65 via associated transmission linkages 64 & 68. Each of the upstream and downstream pressing sections 7 & 8 associated therewith has an upper punch and a lower die. Two upper punch holders 71, 82 have punches 72 & 82 fixed thereto and are driven by the rotation of one set of driving cams 73, 83 (shown at the top of FIG. 27) which are operatively connected to the punch holders via associated linkages 74 & 84. Likewise, the lower set of holders 75, 85 have dies 76 & 86 fixed thereto and rotational movement of the other set of driving cams 77 & 87 is transmitted to these die holders 75, 85 via linkages 78 & 88.

Figure 28:
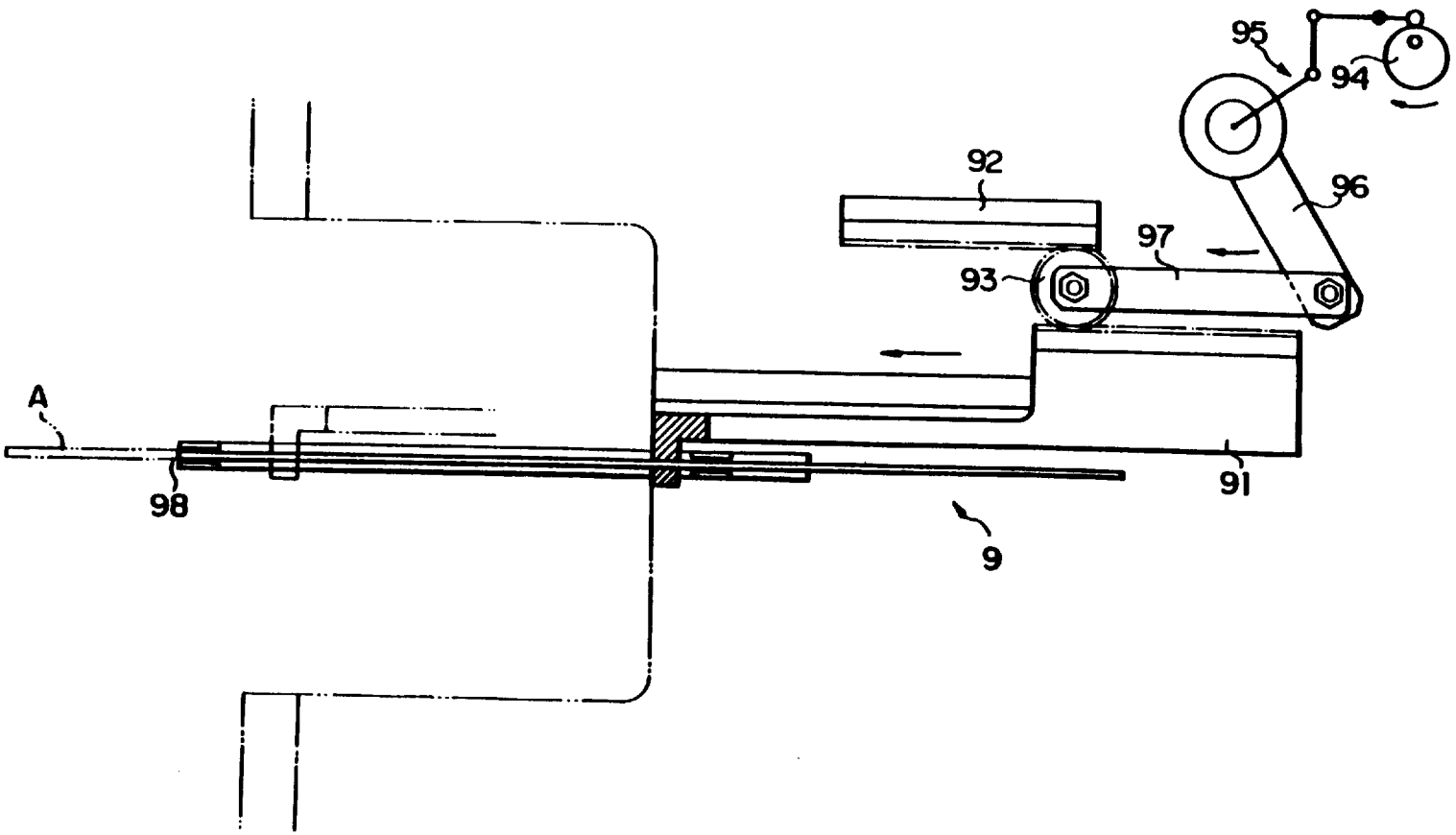
FIG. 28 is an elevational view of the wire harness discharge portion of the embodiment of the wire harness apparatus illustrated in FIGS. 1–11.
Figure 29:
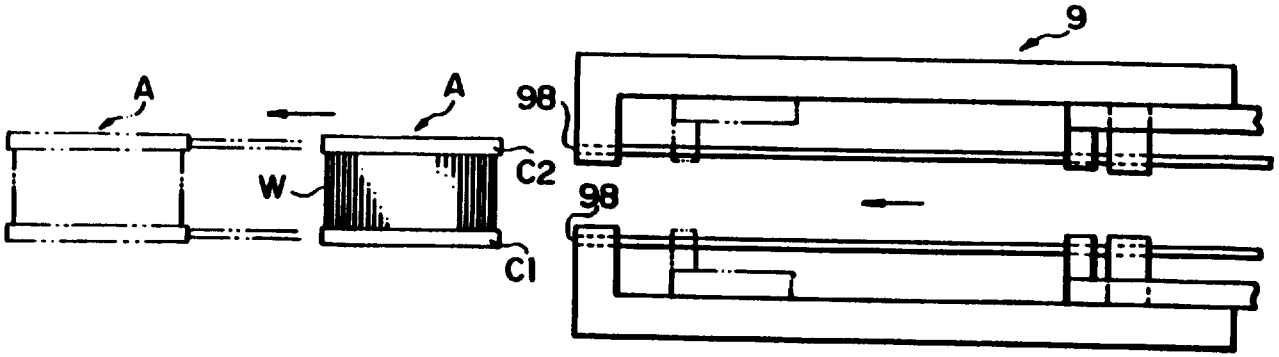
FIG. 29 is a plan view of the wire harness discharge portion of the embodiment of the wire harness apparatus illustrated in FIGS. 1–11.

Referring next to FIGS. 28 & 29, one example of a wire harness discharge section 9 suitable for use with the present invention is detailed. As seen from these drawings, the discharge section 9 includes a movable rack 91 and a stationary rack 92 which are operatively connected together via an intervening pinion member 93. Rotational movement of a driving cam 94 is transmitted to the pinion member 93 via a first linkage 95 and then to second links 96 & 97, thereby permitting the rack 91 to move back and forth in response to rotation of the driving cam 94. A pair of wire harness discharge rods 98 are disposed underneath the movable rack 91 and contact, in their operational movement, assembled wire harness A. The discharge rods 98 impart movement to assembled harness by contacting the connectors terminated to the harness opposing ends. These harness-pushing rods 98 are preferably operated synchronously to evenly thrust the opposing connectors C1, C2 of each assembled harness A in their discharge movement, because otherwise the wire harness would travel obliquely.

Figure 30:
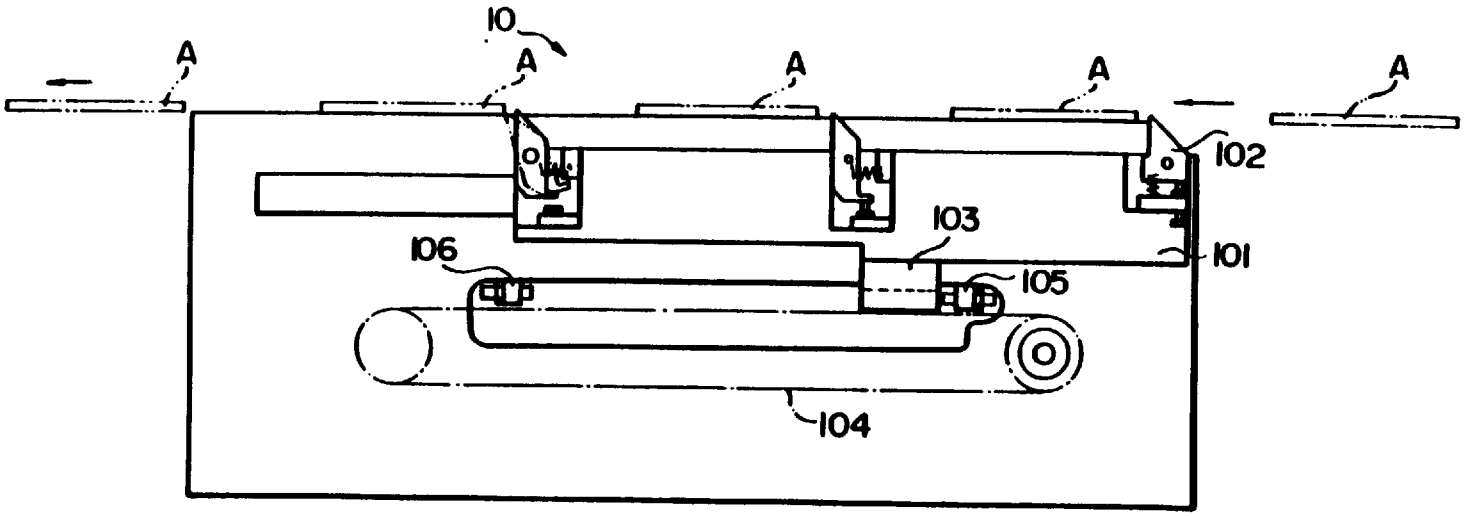
FIG. 30 is an elevational view of the wire harness transfer portion of the embodiment of the wire harness apparatus illustrated in FIGS. 1–11.
Figure 31:
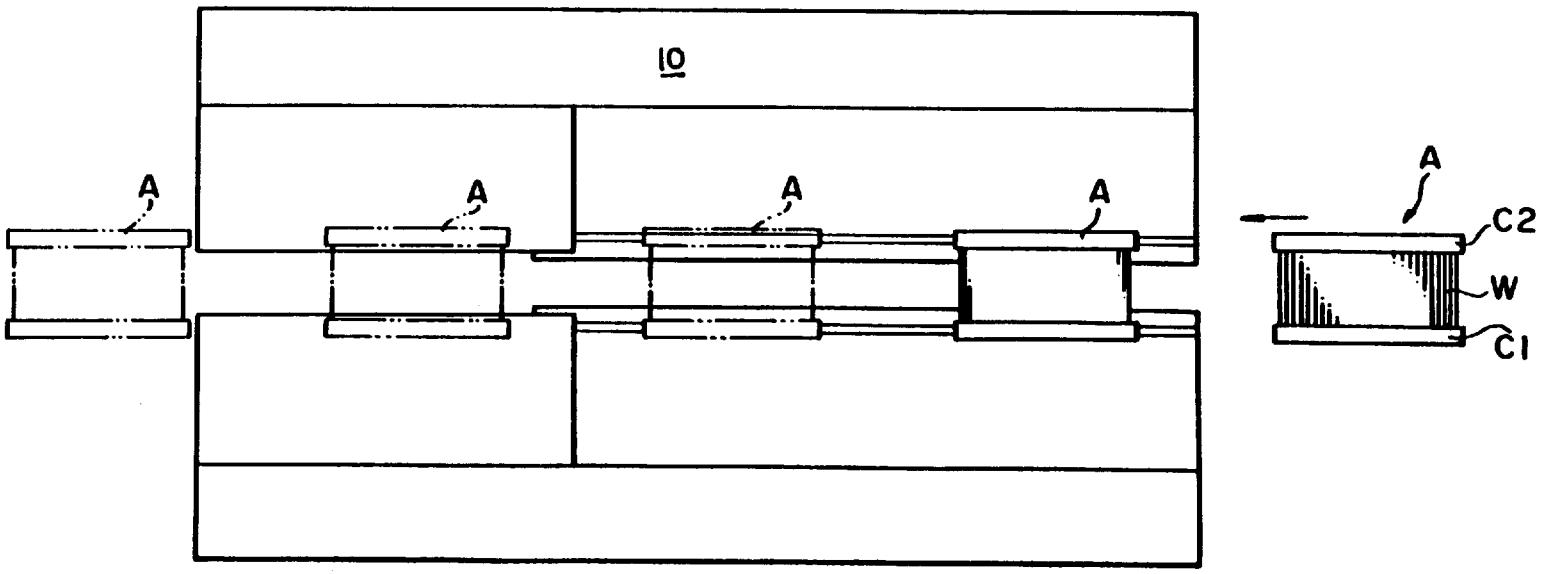
FIG. 31 is a plan view of the movement incurred by discharge of a wire harness from the apparatus; and, FIG. 32 is a perspective view of a partially completed wire harness exemplifying the style of wire harnesses produced by the apparatus of FIGS. 1 and 12.

FIGS. 30 & 31 illustrate a transfer section 10 suitable for use with the present invention for transporting assembled wire harnesses A to a subsequent testing section 11. A transfer table 101, as shown in FIG. 30, has a plurality of shuttle members 102 at regular intervals. These shuttle members 102 appear partly on the transport line, in opposition to the connectors C1 & C2 of each assembled harness A at the opposing ends thereof. The transfer table 101 is attached to an underlying endless belt conveyor 104 via an intervening movement block 103, thus permitting the transfer table 101 to move back and forth along the path indicated in FIGS. 30 & 31. The intervening block 103 is allowed to move between forward and rear stops 105 & 106, thereby limiting the stroke of the transfer table 101 and hence, the need for the shuttle members 102.

Referring back to FIGS. 2 to 11, the manner in which wire harnesses A are made in the apparatus described above will now be explained.

Figure 2:
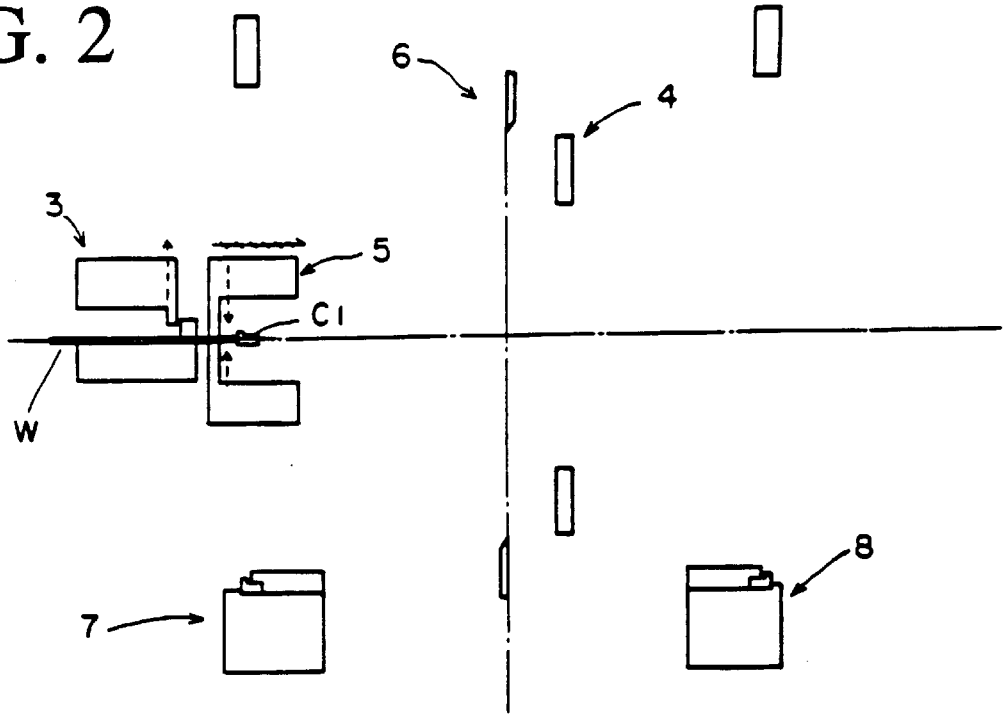
FIG. 2 is an operational schematic diagram of the wire harness apparatus of FIG. 1 illustrating the measuring chuck of the apparatus engaging the wire supply and beginning measuring of the wires extending from their supply reels.
Figure 11:
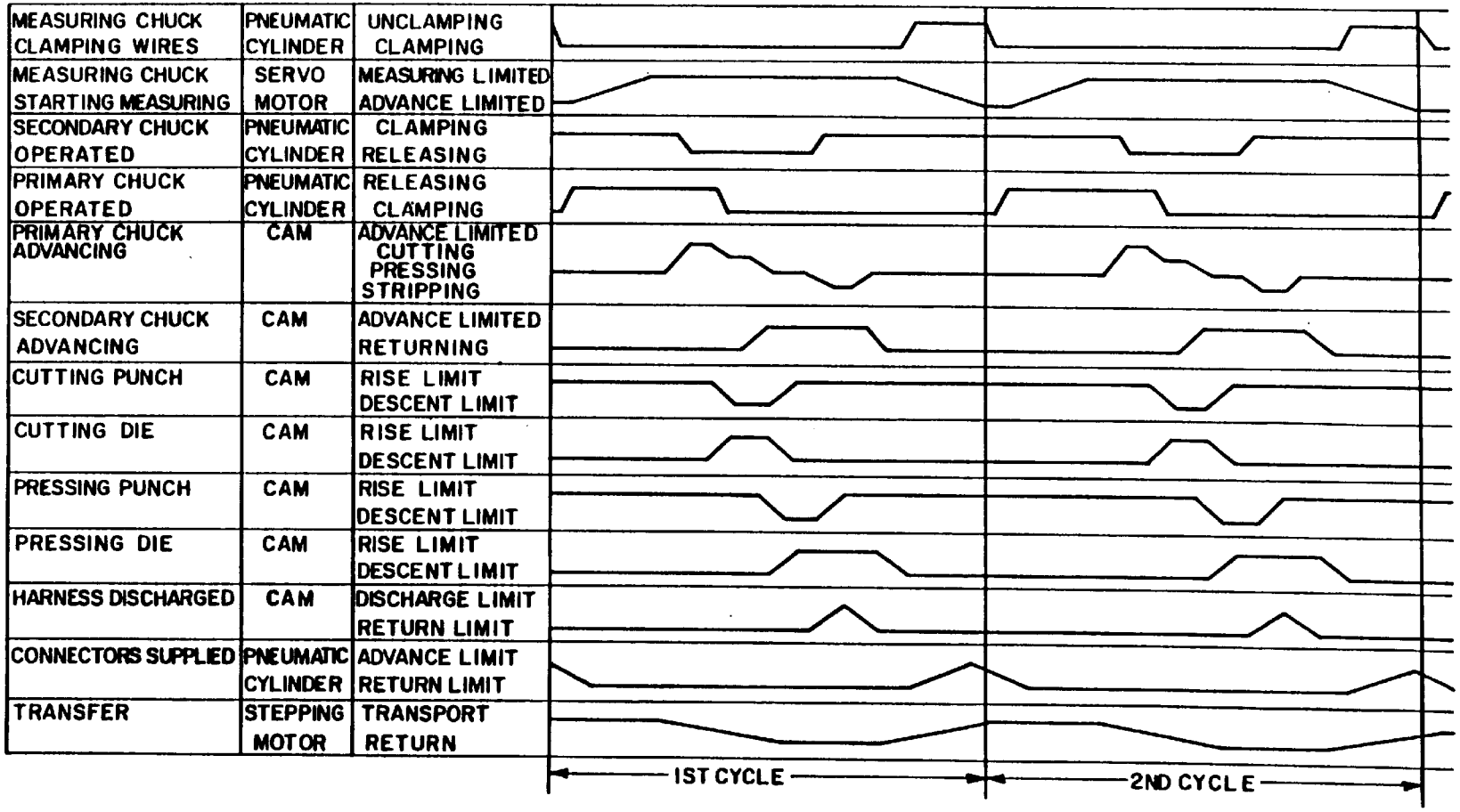
FIG. 11 is a timing chart illustrating the movements of the principal components of the wire harness apparatus of FIG. 1 in the operational movements depicted in FIGS. 2–10 above.
Figure 23:
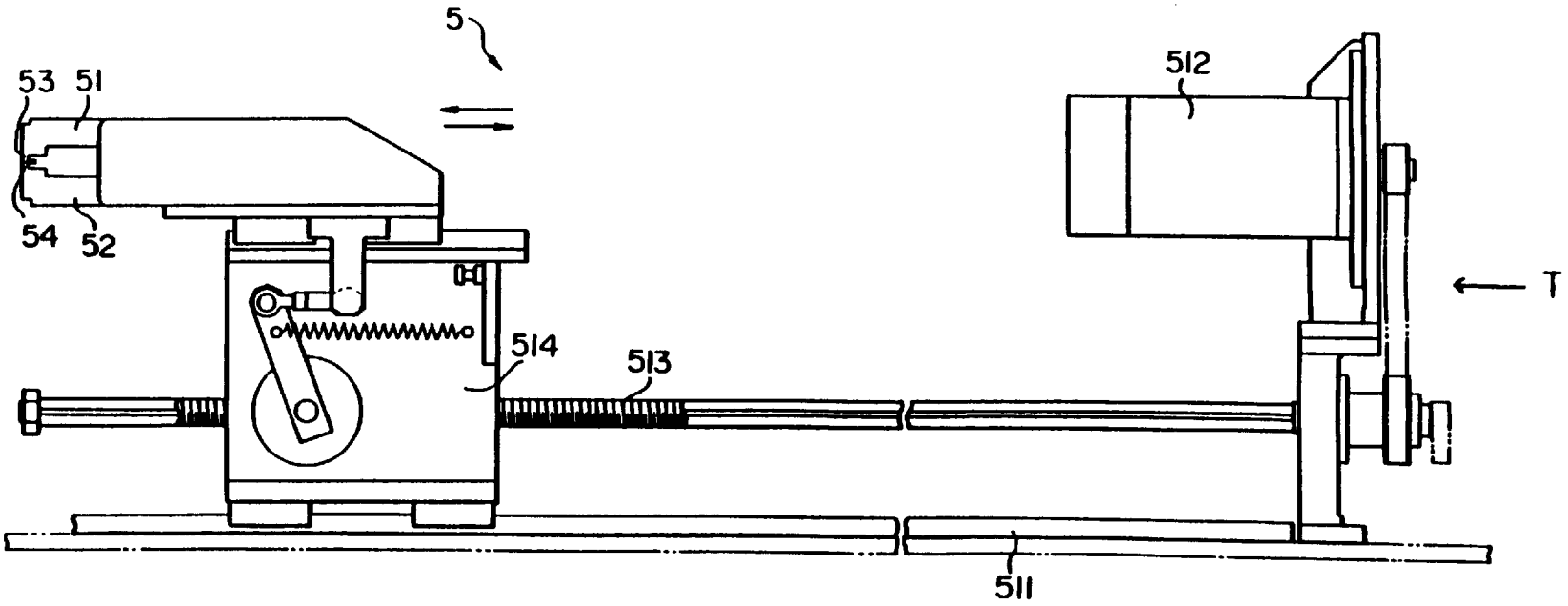
FIG. 23 is an elevational view of the measuring chuck of the wire harness apparatus of the embodiments of FIG. 1 and FIG. 12.
Figure 24:
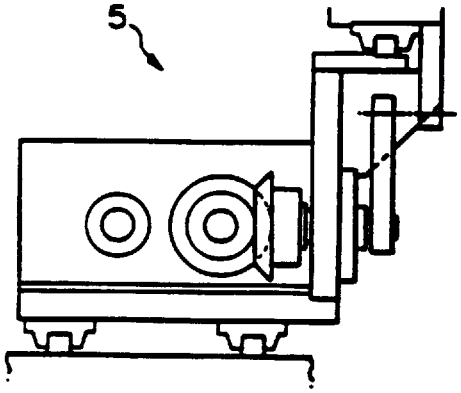
FIG. 24 is an end elevational view of the measuring chuck of the wire harness apparatus of FIG. 23 as viewed in the direction indicated by the arrow T.
Figure 25:
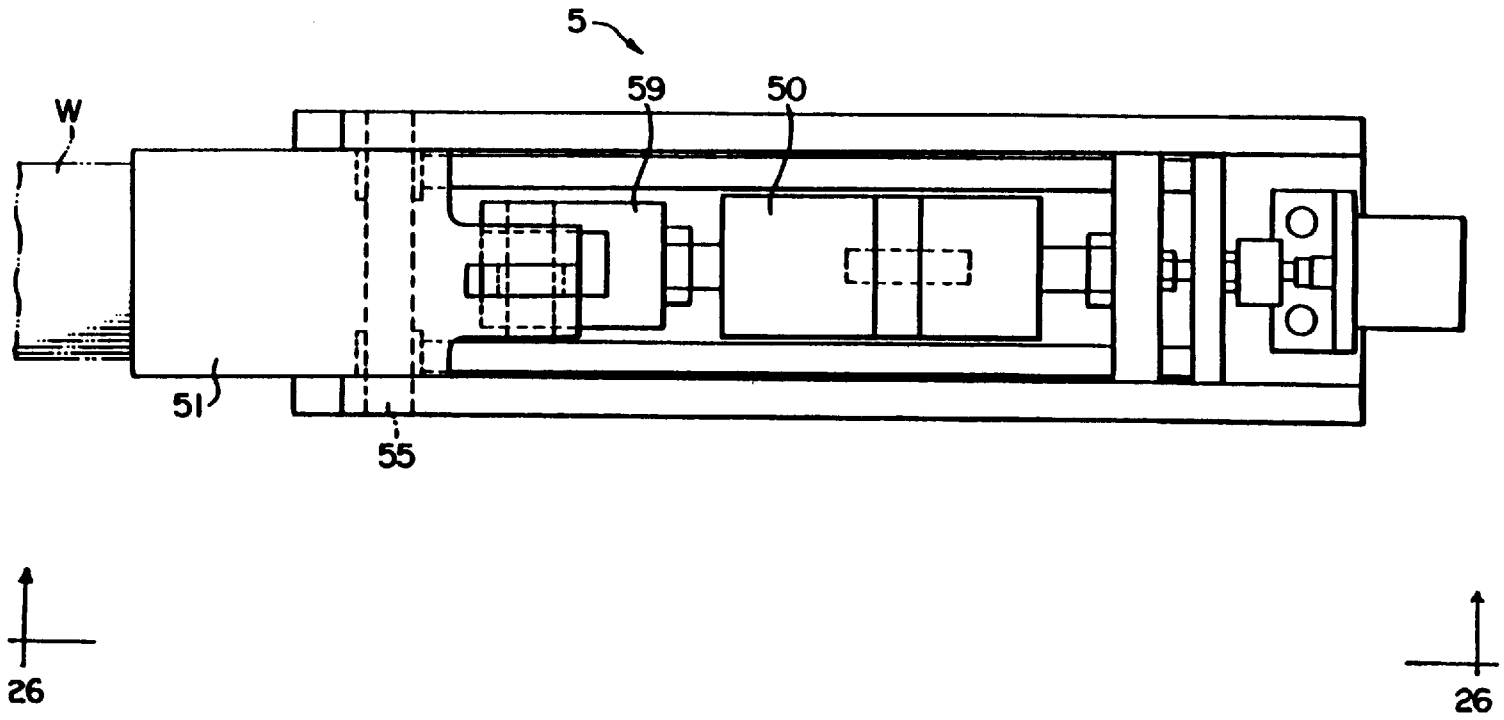
FIG. 25 is a plan view of the wire gripping and releasing portion of the measuring chuck.
Figure 26:
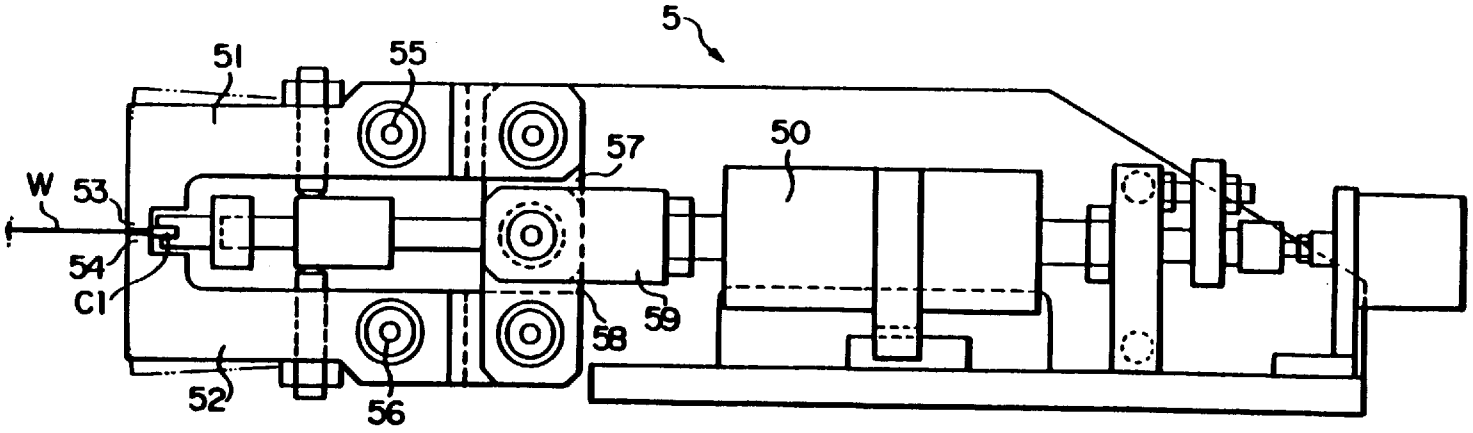
FIG. 26 is an elevational view of the wire gripping and releasing portion of the measuring chuck taken along lines 26—26 of FIG. 25.

FIG. 2 shows the condition in which a working or harness assembly cycle is about to start subsequent to the completion of the precedent working cycle. The measuring chuck 5 is closed and then the wires W extending out from the wire supply reels are clamped as seen in FIG. 11. As shown in FIG. 26, the opening-and-closing chuck arms 51 and 52 are then closed together in order to grip the wires W in their parallel arrangement. This is essentially conducted in one step. In the subsequent step, the primary chuck section 3 is opened. As seen in FIG. 19, the chuck arms 32 are opened to permit the measuring of wires W. Thus, at a third step the required measuring of the wires W is effected by the measuring chuck section 5. As seen in FIG. 23, the servomotor 512 rotates the threaded shaft 513 to drive the movable base 514 until the wires are drawn out to the desired predetermined length by the closed tips 53, 54 of the wire-drawing chuck arms 51 & 52.

Figure 3:
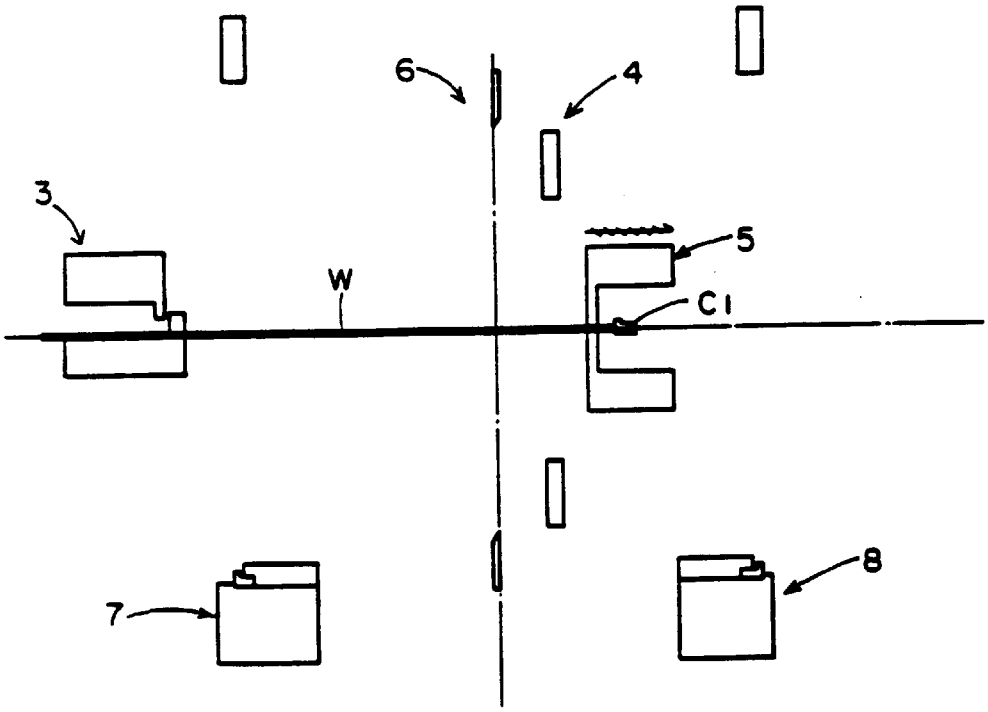
FIG. 3 is an operational schematic diagram of the wire harness apparatus of FIG. 1 illustrating completion of measuring of the wires.

FIG. 3 shows the condition in which the wire-measuring by the measuring chuck 5 is finished in the four sequential steps set out above.

Figure 4:
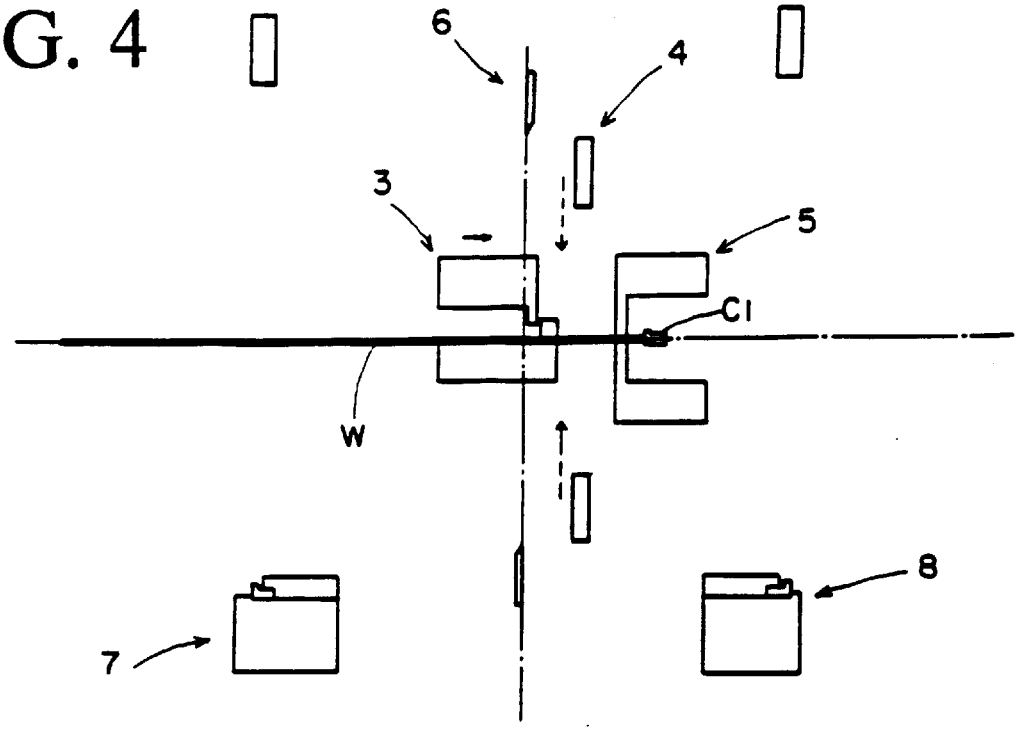
FIG. 4 is an operational schematic diagram of the wire harness apparatus of FIG. 1 illustrating the secondary chuck closing onto the extended wire supply.

As seen best from FIG. 4, at a fifth step the primary chuck section 3 advances to the secondary chuck section 4 and beyond the cutting line of the wire cutting section 6, (indicated by the dashed line extending between the knife blades 6 shown therein). In FIG. 19, rotational movement of cam 374 is transmitted via the transmission linkage 375 which permits the slider 373 to move forward along its associated rails 372. Then, the chuck arms 32 of the primary wire chuck section 3 are opened, thereby permitting the primary chuck section 3 to move forward in proximity to the secondary chuck section 4 without drawing the wires W further formed. Thus, all of the measured wires are guided by the wire-threading pipes 33 of the primary wire chuck section 3 so that they adopt a predetermined parallel arrangement in which adjoining wires are spaced apart at regular intervals. Thanks to this feature, there is no fear of pinching and damaging wires by the secondary chuck section 4 as it operates in subsequent steps. Such undesired pinching would be caused if all of wires so drawn were not arranged laterally at regular intervals.

At a sixth step, the secondary wire chuck section 4 starts its operation. As seen from FIGS. 21 & 22, when the pneumatic cylinders 412 & 413 are activated their pistons 414 & 415 advance and the frame 411 advances. After the wire gripping-and-releasing means is put in the correct position, the pneumatic cylinder 48 withdraws its piston 47, thereby closing the opening-and-closing arms 41, 42 to permit their nails 491 & 492 to close and grip the wires W. As all of the drawn wires are arranged parallel or laterally at regular intervals, the nails 491 & 492 therefore do not pinch the insulations of selected wires which might cause shorting or improper terminations of connectors to the wires.

Figure 5:
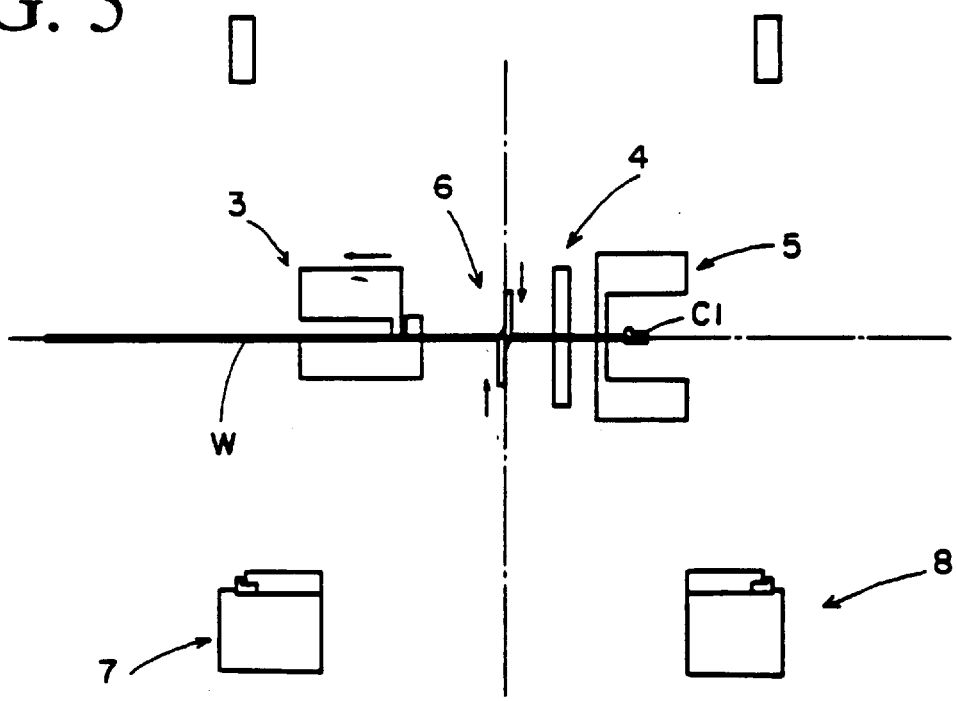
FIG. 5 is an operational schematic diagram of the wire harness apparatus of FIG. 1 illustrating the apparatus cutting the wires drawn from their supply reels to define a wire set.

At a seventh step, the primary wire chuck section 3 returns to the predetermined position as shown in FIG. 5. As seen from FIG. 19, the cam 374 begins its return motion causing the primary wire chuck section 3 to return to the predetermined position under the influence of a return spring 376.

At an eighth step, the primary wire chuck section 3 closes. Specifically, the pneumatic cylinder 35 raises its piston to cause the chuck arm 32 to swing about its pivot, thereby clamping the wires W. At a subsequent ninth step, the wire cutting section 6 is enabled and cuts the measured wires W.

As seen from FIG. 27, rotations of the cutting section driving cams 63, 67 are transmitted to the upper and lower cutting blades 62 and 66 via their associated linkages 64 & 68, thereby activating cutting blades 62 & 66 to contact and cut all of the wires W at their measured length.

Figure 6:
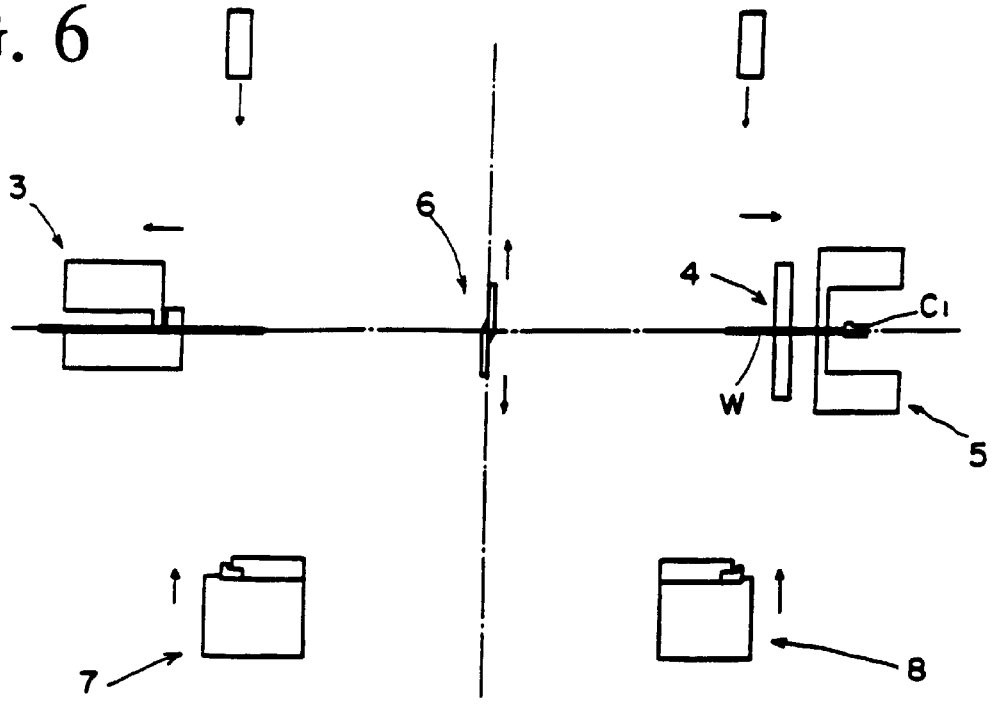
FIG. 6 is an operational schematic diagram of the wire harness apparatus of FIG. 1 illustrating the apparatus separating the cut set of wires and extending the remaining wires from their supply reels.

As seen in FIG. 6, at a tenth step, the primary and secondary wire chuck sections 3 and 4 are separated from each other. Turning to FIG. 19, the cam 374 returns to its original position, and accordingly the primary wire chuck section 3 returns to the backward position behind the upstream pressing section 7 under additional urging of the return spring 376. While the secondary wire chuck section 4 moves forward beyond the downstream pressing section 8, the measuring chuck section 5 is moved synchronously forward by the servomotor 512.

A connector, or connectors, C1 may be terminated to the forward, exposed free ends of the wires W on the side of the primary chuck section 3, whereas a connector C2 may likewise be terminated to the rearward ends of the wires W on the side of the secondary chuck section 4. As the eleventh step, the upper and lower cutting blades 62, 66 open, and then at twelfth and thirteenth steps, the upstream and downstream pressing sections 7 and 8 begin their pressing operations respectively.

As seen in FIG. 27, in the upstream pressing section 7, rotational movement of the pressing section die cams 73 & 77 are transmitted to the pressing punch 72 and the pressing die 76 via their associated linkages 74, 78, thereby pressing a connector C1 onto the forward ends of the wires W, and at the same time, in the downstream pressing section 8 rotational movement of the second pressing section driving cams 83, 87 are transmitted to the pressing punch 82 and the pressing die 86 by way of the linkages 84 & 88, thereby pressing a connector C2 onto the rearward ends of the wires W.

Figure 7:
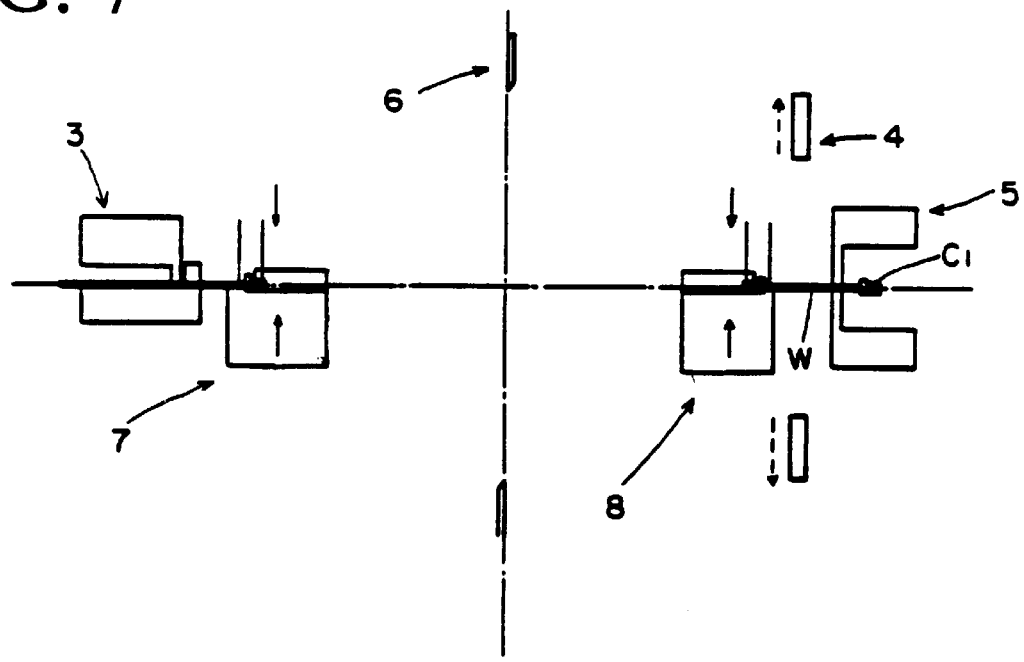
FIG. 7 is an operational schematic diagram of the wire harness apparatus of FIG. 1 illustrating the apparatus terminating connectors onto the first set of wires.

FIG. 7 shows the conditions in which the impressing of the connectors onto the wires are finished at a fourteenth step, and the secondary chuck section 4 opens at a fifteenth step.

Figure 8:
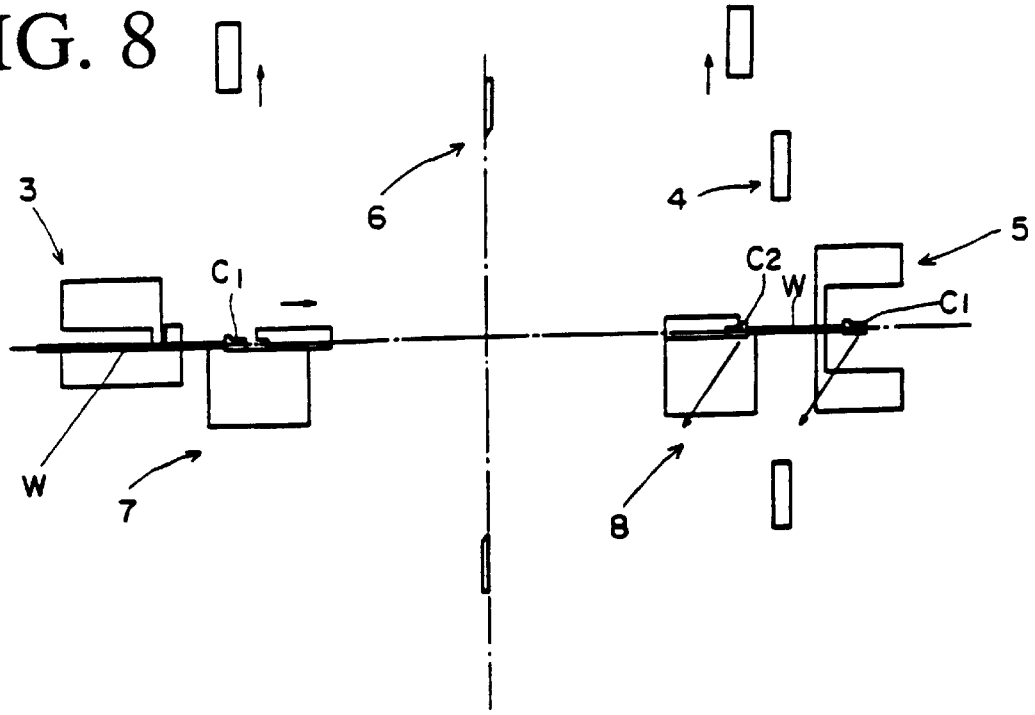
FIG. 8 is an operational schematic diagram of the wire harness apparatus of FIG. 1 illustrating the apparatus completing the assembly of a wire harness.
Figure 9:
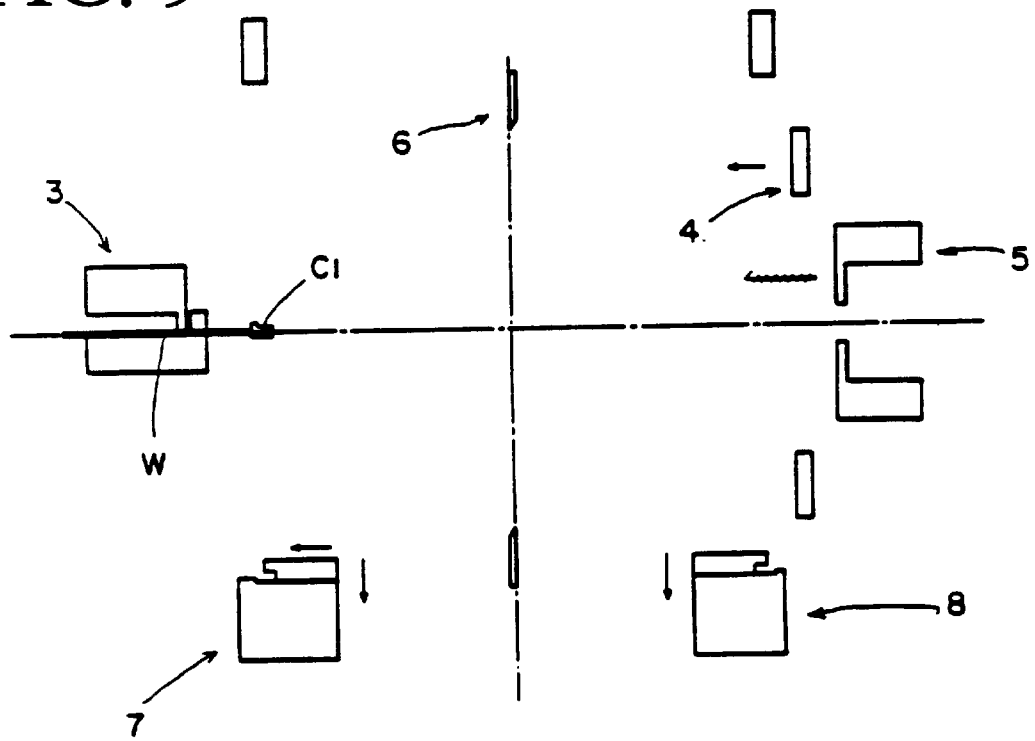
FIG. 9 is an operational schematic diagram of the wire harness apparatus of FIG. 1 illustrating the apparatus withdrawing the measuring chuck.
Figure 10:
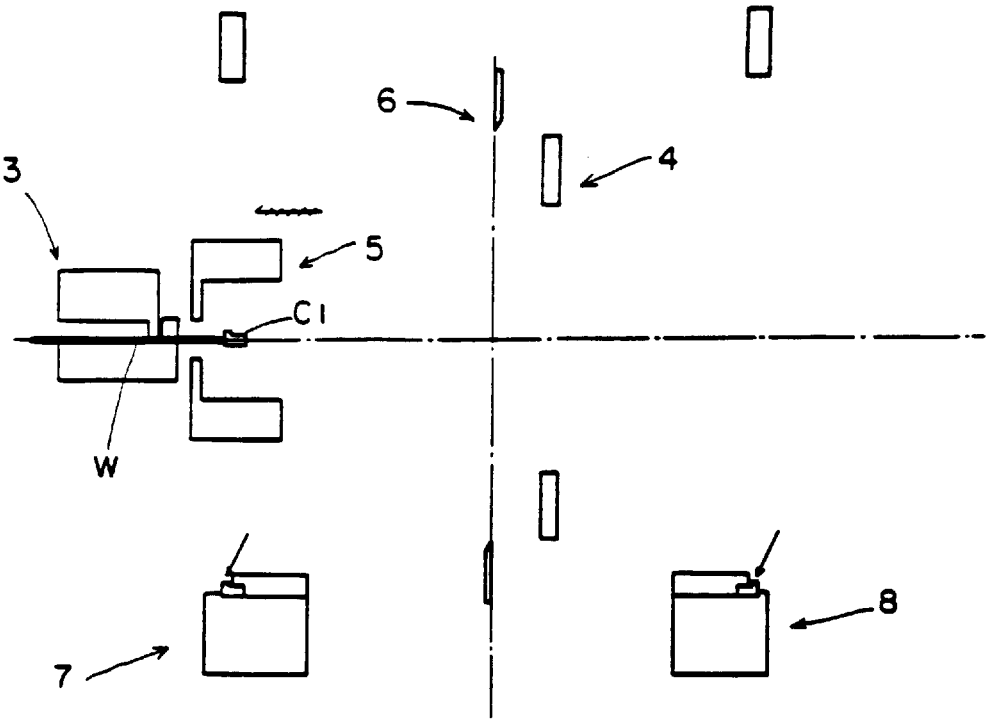
FIG. 10 is an operational schematic diagram of the wire harness apparatus of FIG. 1 illustrating the return of the measuring chuck to its initial position.

FIG. 8 shows that at a sixteenth step, after crimping of the connectors C1, C2 onto the opposing ends of the wires W, the pressing punches 72, 78 of the upstream and downstream pressing sections 7 & 8 are raised. At a seventeenth step, the connector clamp of the upstream pressing section 7 is released and then at a eighteenth step, the electric harness A is discharged.

FIGS. 28 and 29 show one example of a harness discharge mechanism suitable for use with the present invention. In operation, rotation of movement of the cam 94 is transmitted to the drive links 96 and 97 via the transmission linkage 95 to rotate the pinion 93. In FIG. 28, the pinion 93 is meshed with the stationary rack 92 so as to rotate clockwise, and the clockwise rotation of the pinion 93 causes the movable rack 91 to move forward in the direction indicated by the arrow. A pair of harness discharge rods 98 & 98 subsequently move forward to push the electric harness A by engaging its connectors C1, C2. It should be noted that as seen from FIG. 29, the discharge rods 98 & 98 push the opposing connectors C1 and C2 of the electric harness A simultaneously, to thereby eliminate the possibility of the assembled wire harnesses travelling obliquely along their path to a subsequent testing stage, where the wire harness can take its correct posture, thereby permitting unimpeded testing of the assembled harnesses.

FIGS. 30 and 31 show one example of the transfer section 10. In operation, the belt conveyor 101 carries the movable base 101 which permits the transport heads 102 to push harnesses A in serial order, one after another to a subsequent testing section 11 where the assembled harnesses A are subjected to conditioning and other electrical characteristic tests.

Now, referring back to FIG. 9, as a nineteenth step, the pressing dies 76 & 86 of the upstream and downstream pressing sections 7 and 8 are lowered and at a twentieth step, the connector clamp of the processing die 76 closes. As a twenty-first step, the secondary chuck section 4 returns to its initial position and at a twenty-second step, the measuring chuck section 5 begins to measure of the wires for a subsequent assembly cycle. As seen from FIG. 10, as a twenty-third step, electric connectors C1 and C2 are supplied from a connector supply section 12 to both of the upstream and downstream pressing dies 76 and 86, and at a twenty-fourth step, the measuring chuck section 5 returns to its initial position, thus returning the apparatus to its standby condition illustrated in FIG. 2, in which another, subsequent harness making cycle can begin.

As may be understood from the harness-making cycle just described, the principal components of the apparatus include the cam driving at electric connector pressing steps, that is: (1) the step wherein the primary wire chuck section 3 advances proximate to the secondary chuck section 4 just prior to the clamping of the wires by the secondary wire chuck section 4; (2) the step wherein the primary and secondary wire chuck sections 3 & 4 are displaced subsequent to the cutting of the wires by the wire cutting section 6 to separate one end or segment of the cut wires toward the primary wire chuck section 3 and the other end of the cut wires toward the secondary wire chuck section 4; (3) the step wherein the punch 62 and die 66 are operated in the cutting section 6; and, (4) the step wherein the punch and die are operated in the upstream and downstream pressing sections 7 and 8.

Therefore, with the use of the cam driver the time involved for assembly the wire harnesses is substantially reduced as compared with the conventional system using pneumatic cylinders to conduct all the principal connector pressing steps in that with conventional pneumatic-driven harness producing apparatus, the operation of the pneumatic cylinders in any subsequent step cannot begin before confirmation that the operation of the pneumatic cylinders in the preceding step has finished, thus adding a short delay equivalent to the waiting time for each confirmation, thus preventing the shortening of the harness-making cycle below a certain limit. The cam-driving of the associated components set out above thereby permits the starting of sequential steps without confirming the completion of each preceding step, thus substantially shortening the harness-making cycle by at least the cumulative waiting time described above which is experienced with pneumatic driven apparatus.

When it is desired that a connector is crimped only onto one set of free end of the parallel wire arrangement, it suffices that the pressing operation at the upstream pressing section is omitted.

Referring to FIGS. 12 to 16 a second embodiment of an apparatus for producing wire harnesses constructed in accordance with the principles of the present invention is illustrated, in which a connector is terminated to one end of the parallel wire arrangement while the wires are stripped on the other opposite ends. The termination of the connector C1 to the one end of the parallel wire arrangement, the measuring of the wires, the cutting of the wires and the separating of the two parts of the cut wires by the primary and secondary chucks 3 and 4 are effected in the same way as in the harness producing apparatus of the first embodiment (see FIGS. 2 to. 6). However, at a twenty-fifth step, as shown in FIG. 12, the upper and lower stripping blades 14 are brought into contact with the wires and cut into the insulations of the wires W near their free ends.

At a twenty-seventh step (FIG. 13), the primary chuck section 3 moves rearward and as a twenty-eighth step, the cut insulation pieces R are removed by an air stream, thus exposing the conductors S from the insulation ends of the parallel wires. As twenty-ninth and thirty-first steps in FIGS. 14–16, the upper and lower stripping blades 14 return to their original positions. The remaining components other than the remaining components stripping blades 14 function in the same way as in the first embodiment, particularly at subsequent thirtieth, thirty-second, thirty-third, thirty-fourth, thirty-fifth and thirty-sixth steps.

As described earlier, the insulation-stripping blades 14 are spaced apart from the wire-cutting blades 62 & 66 as shown in FIG. 27. The stripping is effected at a position apart from the wire-cutting position and at this step independent from the wire-cutting step, and therefore it is possible that the shortest amount of insulation necessary can be removed from the parallel wires. In conventional harness producing apparatus, the relatively thick wire-cutting blades and the relatively thin insulation-stripping blades are laid up on each other and the wire-cutting and the insulation-cutting are effected simultaneously. Therefore, the insulations of a length or lengths of wire which is shorter than the thickness of the wire-cutting blade cannot be removed from the wires. In contrast, in a wire harness producing apparatus constructed in accordance with the present invention, the insulations of wire lengths which are equal to the thickness of the stripping blade can be easily removed from the free ends of the cut wires.

As may be apparent from the above, a harness producing apparatus according to the present invention can work at the shortest working cycle possible because of no necessity for waiting for a confirmation of the completion of each preceding working step. The primary wire chuck is made to advance beyond the cutting position to the proximity of the secondary chuck section, thereby holding a plurality of parallel wires at regular intervals, assuring that the insulations of selected wires are not pressed and damaged by undesired pressing when the secondary wire chuck clamps the parallel wires. In the discharge of assembled wire harnesses, the simultaneous engagement of the opposing connectors terminated to each harness by the opposing harness discharge pushing rods assures that no harnesses will travel obliquely on the way to the subsequent testing section, thus assuring that every harness may take a correct posture for testing. Finally, the insulation-stripping can be effected at a position away from the wire-cutting position and as a step which independent from the wire-cutting step. Therefore, insulations of a possible shortest length equal to the thickness of the insulation-stripping blade can be removed from parallel wires.

It will be appreciated that the embodiments of the present invention discussed herein are merely illustrative of a few applications of the principles of the invention. Numerous modifications may be made by those skilled in the art without departing from the true spirit and scope of the invention.

I claim:

1. An apparatus for producing wire harnesses, each wire harness having a plurality of elongated wires extending between first and second electrical connector elements which are interconnected to opposing first and second ends of said wires, the apparatus comprising:

a wire supply;

first means for feeding a plurality of wires from the wire supply into said apparatus such that said wires enter said apparatus are arranged in a prearranged spaced-apart order;

means for extending said wires along a wire harness processing feedpath of said apparatus and measuring a predetermined length of said wires which corresponds to a final desired wire length of an assembled wire harnesses;

means disposed along said apparatus feedpath for cutting said wires to define said predetermined length of said wires after the measuring thereof, said wire cutting means defining opposing first and second ends of said predetermined length of wires;

first means for maintaining said wires in said prearranged spaced-apart order as said predetermined length of wires is advanced along said apparatus feedpath and during measuring and cutting, the first wire-maintenance means engaging said predetermined length of wires proximate to said first ends thereof;

first means for applying a first electrical connector element to said first ends of said wires while said wires are engaged by said first wire-maintenance means;

second means for maintaining said predetermined length of wires in said prearranged spaced-apart order as said predetermined length of wires is advanced along said apparatus feedpath during and subsequent to cutting of said wires, the second wire-maintenance means engaging said predetermined length of wires proximate to said second ends thereof;

second means for applying a second electrical connector element to said second ends of said wires while said wires are engaged by said second wire-maintenance means in order to provide an assembled wire harness; and, means for discharging the assembled wire harness from said apparatus to a subsequent working stage by contacting said first and second connector elements at said opposite ends of said assembled wire harness, said first and second wire-maintenance means, wire cutting means, first and second wire connector application means and wire harness discharging means all being driven by cam drive means.

2. The wire harness assembly apparatus as defined in claim 1, wherein said first and second wire-maintenance means respectively include primary and secondary wire chucks spaced apart from each other, said primary and secondary chucks each including two opposing faces which engage said wires along a path generally transverse to said apparatus feedpath and maintain them in said prearranged spaced-apart order.

3. The wire harness assembly apparatus as defined in claim 2, wherein said wires are maintained in a generally parallel order.

4. The wire harness assembly apparatus as defined in claim 1, wherein said first and second connector application means and said wire cutting means are driven by respective sets of drive cams, said first and second connector application means and said wire cutting means being driven by said drive cams in directions generally transverse to said apparatus feedpath.

5. The wire harness assembly apparatus as defined in claim 1, wherein said wire measuring means is disposed in said apparatus downstream of said first wire-maintenance means and includes a wire-measuring chuck reciprocatably driven along said apparatus feedpath.

6. The wire harness assembly apparatus as defined in claim 1, wherein said first and second connector application means include opposing punch and die members disposed on opposite sides of said wire cutting means said opposing punch and die members and which engage said wires along a path generally transverse to said apparatus feedpath in order to apply said first and second electrical connector elements to said first and second ends of said predetermined length of wires.

7. The wire harness assembly apparatus as defined in claim 2, wherein said primary chuck opposing faces include opposing jaw members which selectively operatively engage said wires.

8. The wire harness assembly apparatus as defined in claim 1, further including means for stripping insulation from the ends of said predetermined length of wires, the wire-stripping means being operatively associated with said wire-cutting means, said wire-cutting means having a pair of opposing cutting blades and said wire-stripping means having a pair of opposing stripping blades spaced apart from said cutting blades and further being separately actuatable therefrom.

9. The wire harness assembly apparatus as defined in claim 1, wherein said wire-extending means includes a wire inlet section having a plurality of wire-advancement rollers, the rollers having a plurality of spaced-apart channels which receive said wires from said wire supply and feed said wires into said wire measuring means.

10. The wire harness assembly apparatus as defined in claim 1, wherein said assembled wire harness discharge means includes first and second reciprocating push rods, each of said push rods respectively contacting only said first and second electrical connector elements at said opposing ends of said assembled wire harnesses to thereby exert an even discharge force upon said assembled wire harness.

11. The wire harness assembly apparatus as defined in claim 1, further including means for transporting said assembled wire harnesses out of said apparatus feedpath, said wire harness transport means including pairs of wire harness engagement heads which engage said assembled wire harnesses and incrementally advance said assembled wire harnesses through said apparatus.

12. An apparatus for assembling wire harnesses in which each wire harness has at least one electrically conductive wire of a predetermined length, and first and second electrical connector elements attached to said wire at opposite ends of the harness, said first and second connector elements respectively engaging first and second free ends of said wire, the apparatus comprising:

a wire supply, means for feeding said wire from said wire supply into said apparatus, a wire inlet for guiding said wire into said apparatus in a prearranged order, wire measuring means including a wire measuring chuck which selectively engages said wire downstream of said wire inlet and draws out a predetermined length of wire from said supply, said wire measuring chuck being driven along an assembly path of said apparatus which extends longitudinally along said apparatus, a wire cutter reciprocatably driven by a first cam drive into and out of said apparatus assembly path to cut said wire to define opposing first and second free ends of successive predetermined lengths of wire along said apparatus assembly path, a primary wire chuck for engaging said predetermined length of wire near said first free end thereof and retaining said wire length in said prearranged order as it is processed in said apparatus along said assembly path, said first wire chuck being driven along said apparatus assembly path by a second cam drive, first and second presses for terminating respective first and second electrical connector elements to said first and second free ends of said predetermined lengths of wire as they move along said apparatus assembly path, said first press being reciprocatably driven by a third cam drive into and out of said apparatus assembly path, said first press being disposed downstream of said wire inlet and upstream of said wire cutter, said second press being disposed downstream of said wire cutter and said primary wire chuck and further being reciprocatably driven by a fourth cam drive in and out of said apparatus assembly path, a secondary wire chuck disposed downstream of said primary wire chuck and said wire cutter for engaging said second free end of said wire length and for maintaining said wire length in said prearranged order, said secondary wire chuck being reciprocatably driven by a fifth cam drive along said apparatus assembly path, said secondary wire chuck further being spaced apart from said primary wire chuck.

13. The apparatus as defined in claim 12, wherein said secondary wire chuck reciprocates along said apparatus assembly path between approximately downstream of said wire cutter and approximately downstream of said second press.

14. The apparatus as defined in claim 12, further including an assembled harness discharge mechanism including a pair elongated pushrods aligned with said connector elements terminated to opposite ends of said wire harness, said pushrods being driven in a reciprocating movement by a sixth cam drive.

15. The apparatus as defined in claim 12, further including a wire-stripper having two wire stripping blades spaced apart from said wire cutter and further spaced apart from said primary and secondary wire chucks, said wire-stripper being reciprocatably driven by a seventh cam drive in and out of said apparatus assembly path, said two wire stripping blades engaging said first and second free ends of said predetermined length of wire.

16. The apparatus as defined in claim 12, wherein said predetermined length of wire includes a plurality of spaced apart wires, said primary and secondary chucks maintaining said wires in said prearranged order.

17. The apparatus as defined in claim 12, wherein said second and fifth cam drives respectively drive said primary and secondary wire chucks in a manner such that said secondary wire chuck is always spaced apart and downstream from said primary wire chuck.

18. The apparatus as defined in claim 12 wherein said secondary wire chuck is disposed upstream of said wire measuring chuck and engages said predetermined length of wire near said second free end thereof as said wire measuring chuck moves along said apparatus assembly path after said wire cutter has cut said predetermined length of wire to thereby maintain said predetermined length of wire in said prearranged order.

* * * * *